United States Patent [19]

Takamuki et al.

[11] Patent Number: 4,988,603

[45] Date of Patent: Jan. 29, 1991

[54] METHOD FOR THE FORMATION OF HIGH-CONTRAST IMAGES USING A DEVELOPER COMPRISING A HYDRAZINE DERIVATIVE

[75] Inventors: Yasuhiko Takamuki; Takeshi Habu; Junichi Fukawa, all of Hachioji, Japan

[73] Assignee: Konica Corporation, Tokyo, Japan

[21] Appl. No.: 287,438

[22] Filed: Dec. 21, 1988

[30] Foreign Application Priority Data

Jan. 11, 1988 [JP] Japan ..... 63-3576
Jan. 11, 1988 [JP] Japan ..... 63-3579

[51] Int. Cl.[5] ..... G03C 5/00; G03C 5/24

[52] U.S. Cl. ..... 430/264; 430/265; 430/267; 430/268; 430/434; 430/436; 430/438; 430/440; 430/464; 430/489; 430/566; 430/603

[58] Field of Search ..... 430/264, 265, 267, 268, 430/434, 436, 438, 440, 464, 489, 566, 603

[56] References Cited

U.S. PATENT DOCUMENTS

| | | | |
|---|---|---|---|
| 2,952,539 | 9/1960 | Dersch et al. | 430/489 |
| 2,955,036 | 10/1960 | Dersch et al. | 430/489 |
| 3,576,633 | 4/1971 | Henn et al. | 430/489 |
| 4,247,620 | 1/1981 | Nagatani et al. | 430/265 |
| 4,269,929 | 5/1981 | Nothnagle | 430/264 |
| 4,276,374 | 6/1981 | Mifune et al. | 430/489 |
| 4,659,647 | 4/1987 | Vacca et al. | 430/265 |
| 4,686,167 | 8/1987 | Resnick et al. | 430/264 |
| 4,740,452 | 4/1988 | Okutsu et al. | 430/265 |
| 4,756,997 | 7/1988 | Marchesano | 430/266 |
| 4,859,567 | 8/1989 | Okutsu et al. | 430/265 |

FOREIGN PATENT DOCUMENTS

| | | | |
|---|---|---|---|
| 104351 | 4/1984 | European Pat. Off. | 430/264 |
| 203468 | 12/1986 | European Pat. Off. | 430/264 |
| 40629 | 3/1979 | Japan | 430/264 |
| 89738 | 7/1981 | Japan | 430/265 |

OTHER PUBLICATIONS

R.D. 17643, "Photographic Silver Halide . . . ", 12/78.
R.D. 18359, "Processing Method . . . ", 7/79.

*Primary Examiner*—Paul R. Michl
*Assistant Examiner*—Patrick A. Doody
*Attorney, Agent, or Firm*—Finnegan, Henderson, Farabow, Garrett and Dunner

[57] ABSTRACT

A processing method for silver halide photographic material is disclosed, which stably provides images having high contrast and high dot quality with little degradation in sensitivity by rapid processing. In the method, a silver halide light-sensitive material having a silver halide emulsion layer containing a 3-pyrazolidone type compound, a dihydroxybenzene type compound or trihydroxybenzene type compound, is developed by a developer containing a di- or trihydroxybenzene type compound; a sulfite and an amino compound in the presence of a compound represented by the following Formula 1, 2 and 3;

Formula 1

Formula 2

Formula 3

25 Claims, No Drawings

METHOD FOR THE FORMATION OF HIGH-CONTRAST IMAGES USING A DEVELOPER COMPRISING A HYDRAZINE DERIVATIVE

FIELD OF THE INVENTION

The present invention relates to a method of forming images, and more particularly to a method of forming silver images which is capable of rapidly and stably providing high-contrast, high-sensitivity photographic images.

BACKGROUND OF THE INVENTION

In general, high-contrast photographic images are used for the formation of character images or color separation halftone dot images in the photomechanical process or for the formation of finely detailed line drawing images in the super-high resolution photomechanical process. Accordingly, certain silver halide photographic materials for use in such processes are known to be capable of forming very high-contrast photographic images.

There is a conventional image-forming method in which a light-sensitive material comprised of a silver chlorobromide emulsion whose silver halide grains have an average grain size of, for example, 0.2 μm, a narrow grain size distribution and uniform configuration and whose silver chloride content is as high as at least 50 mole % is processed in an alkaline hydro-quinone developer solution having a low sulfite ion concentration to thereby obtain high-contrast, high-sharpness and high-resolution images such as, e.g., halftone dot or fine line drawing images.

Silver halide light-sensitive materials of such the kind are known as lith-type light-sensitive materials.

The photomechanical process includes a process for converting a continuous-tone original image into a halftone dot image, i.e., the process for converting changes in the density of the continuous tone of an original into an assemblage of dots having areas proportional to the respective densities.

In this process, the above-mentioned lith-type light-sensitive material is used, exposed through a crossline screen or contact screen to an original image, and then developed, whereby a halftone dot image is formed.

To accomplish this, a silver halide light-sensitive photographic material having a fine-grained silver halide emulsion comprising silver halide grains uniform in the grain size as well as in the grain configuration is used, but even when a light-sensitive material of this kind is used, if processed in a developer solution for general black-and-white developing use, the obtained results will be inferior in the halftone dot image formation to those obtained when processed in a lith-type developer solution. Therefore, the light-sensitive material should be processed in a lith-type developer solution of a single hydroquinone developing agent and an extremely low sulfite ion concentration. However, the lith-type developer solution, since its preservability is very poor due to its proneness to undergo autoxidation, essentially needs a control method to keep its developing quality constant even when used continuously over a long period. Every effort has hitherto been made to improve the preservability of this developer solution.

As for the improvement, a replenishing method which, in order to retain the lith-type developer solution's preservability, separately uses both a replenisher to make up for the deterioration of the solution's activity due to development (processing fatigue replenishment) and a replenisher to make up for the exhaustion of the solution due to its autoxidation in time (spontaneous fatigue replenishment), the so-called two-liquid separately replenishing method, is generally widely employed in automatic processors for photomechanical process use. The above method, however, has the disadvantage that it requires control of replenishing balance of the two liquids, thus complicating the processor as well as its operation.

Also, the lith-type developer solution is unable to quickly provide processed images because it takes time (introduction period) until when an image begins to appear in its developing process.

On the other hand, methods for obtaining rapidly high contrast images without using the above-mentioned lith-type developer solution are known, which comprise incorporation of a hydrazine compound into a silver halide light-sensitive material as described in, e.g., U.S. Pat. No. 2,419,975, Japanese Patent Publication Open to Public Inspection (hereinafter referred to as Japanese Patent O.P.I. Publication) Nos. 16623/1976 and 20921/1976. According to these methods, the sulfite ion concentration can be maintained high in a developer solution, so that processing can take place in a developer solution with its preservability being raised. However, any of these methods requires the use of a fairly high pH having developer solution in order to give a high-contrast image, so that they come into question in respect of the developer solution's stability if they are to be used as the technique to provide high-sensitivity images rapidly. Also, this developer solution has another disadvantage that its pH is so high as to tend to fog the light-sensitive material in processing, motivating the incorporation of various organic antifoggants in a high concentration into the solution, thus resulting in the sacrifice of the sensitivity.

SUMMARY OF THE INVENTION

It is a first object of the present invention to provide a method for the formation of images which is capable of forming high-contrast images rapidly and stably.

It is a second object of the present invention to provide a method for the formation of images which is capable of forming high-sensitivity, high-contrast images stably with little or no loss of sensitivity.

It is a third object of the present invention to provide a method for the formation of images which is capable of forming high-contrast images with little fog.

It is a fourth object of the present invention to provide a method for the formation of images which is capable of forming high-contrast images having an excellent halftone dot quality.

Other objects of the present invention will become apparent according to the following description of this specification.

The above objects of this invention is accomplished by a method for forming an image comprising a step of development of a silver halide photographic light-sensitive material having a silver halide emulsion layer in a developer, wherein said silver halide emulsion layer contains a compound selected from the group consisting of s-pyrazolidone-type compounds, dihydroxybenzene-type compounds or trihydroxybenzene-type compounds, and the developer contains a compound selected from the group consisting of dihydroxybenzene-type compounds and trihydroxybenzene-type compounds, a sulfite and amino compounds; said development being performed in the presence of a compound selected from the group consisting of compounds represented by the following Formulas 1, 2 and 3:

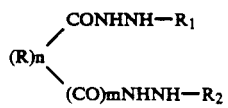

Formula 1 wherein $R_1$ and $R_2$ each represents an aryl group or a heterocyclic group, R represents a divalent organic group, n is an integer of zero to 6, and m is an integer of zero to 1, provided that when n is 2 to 6, the Rs are the same as or different from each other,

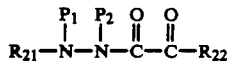

Formula 2 wherein $R_{21}$ is an aliphatic group, an aromatic group or a heterocyclic group; $R_{22}$ is a hydrogen atom, an alkoxy group, a heterocyclic oxy group, an amino group, or an aryloxy group; $P_1$ and $P_2$ each represents a hydrogen atom, an acyl group or a sulfinic acid group,

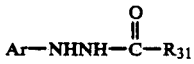

Formula 3 wherein Ar is an aryl group containing a non-diffusible group or a silver halide adsorption accelerating group; and $R_{31}$ is a substituted alkyl group.

DETAILED DESCRIPTION OF THE INVENTION

The construction of this invention will be described to a greater detail in the following:

The foregoing Formulas 1, 2 and 3 will be further detailed below:

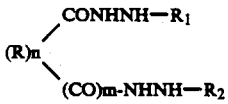

Formula 1 wherein $R_1$ and $R_2$ each represents an aryl group or a heterocyclic group, which each may have a substituent; R is a divalent organic group; n is an integer of zero to 6; and m is an integer of zero or 1.

Herein, the aryl group represented by the $R_1$ or $R_2$ is a phenyl, naphthyl or the like group, and the heterocyclic group is a pyridyl, benzothiazolyl, quinolyl, thienyl or the like group, but the $R_1$ or $R_2$ is preferably the aryl group. The aryl group or heterocyclic group represented by the $R_1$ or $R_2$ include those having one of various substituents, examples of which include a halogen atom such as chlorine, bromine, etc.; an alkyl group such as methyl, ethyl, dodecyl, etc.; an alkoxy group such as methoxy, ethoxy, isopropoxy, butoxy, octyloxy, dodecyloxy, etc., an acylamino group such as acetylamino, pivalylamino, benzoylamino, tetradecanoylamino, α-(2,4-di-t-amylphenoxy)butylamino, etc.; a sulfonylamino group such as methanesulfonylamino, butanesulfonylamino, dodecanesulfonylamino, benzenesulfonylamino, etc.; an ureido group such as phenylureido, ethylureido, etc.; a thioureido group such as phenyl-thioureido, ethyl-thioureido, etc.; a hydroxy group; an amino group; an alkylamino group such as methylamino, dimethylamino, etc., a carboxy group; an alkoxycarbonyl group such as ethoxycarbonyl; a carbamoyl group; a sulfo group; and the like. The divalent organic group represented by the R is, for example, an alkylene group such as methylene, ethylene, trimethylene, tetramethylene, etc.; an arylene group such as phenylene, naphthylene, etc.; an aralkylene group; or the like, but the alkylene group may contain in its linkage an oxygen atom, sulfur atom, selenium atom, carbonyl group,

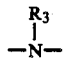

group (wherein $R_3$ represents a hydrogen atom, alkyl group or aryl group), sulfonyl group, or the like. The group represented by the R includes one having one of various substituents, examples of which include a —CONHNHR$_4$ group (wherein $R_4$ is as defined in the foregoing $R_1$ and $R_2$), alkyl group, alkoxy group, halogen atom, hydroxy group, carboxy group, acyl group, aryl group, and the like.

Preferred as the R is the alkylene group.

Preferred among those compounds having Formula 1 is a compound of the formula in which the $R_1$ and $R_2$ are substituted or unsubstituted phenyl groups, n=m=1, and the R represents an alkylene group.

Typical compounds having the above Formula 1 are as follows:

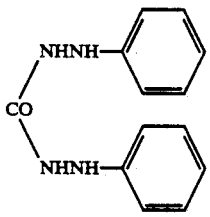

1-1

-continued
1-2
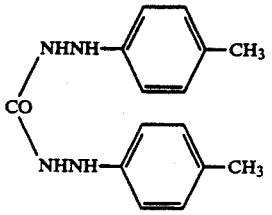
1-3
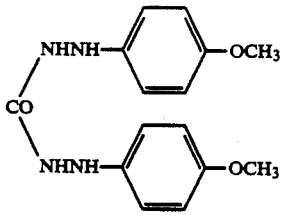
1-4
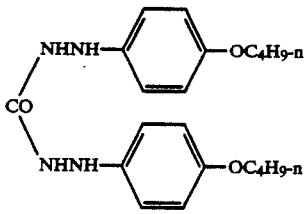
1-5
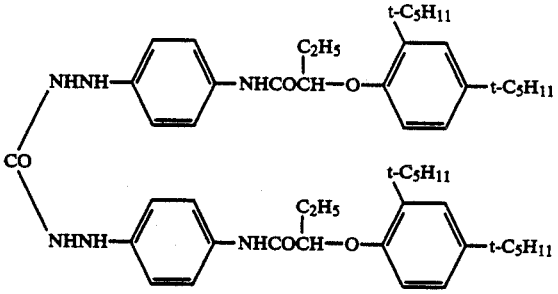
1-6
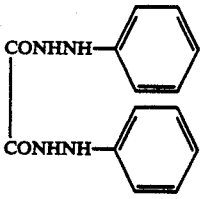
1-7
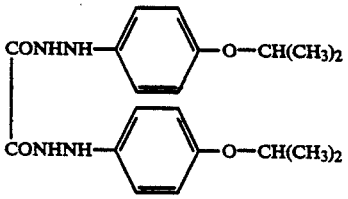
1-8
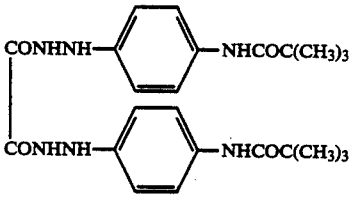

-continued
1-9
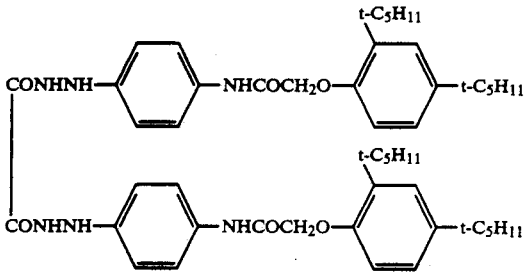
1-10
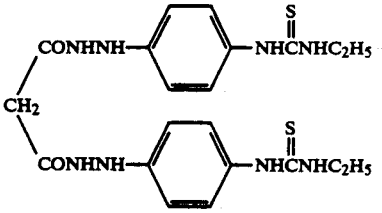
1-11
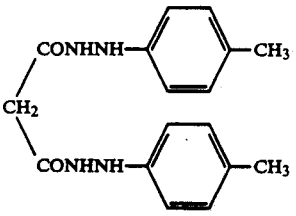
1-12
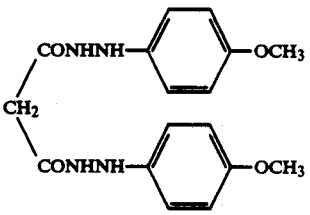
1-13
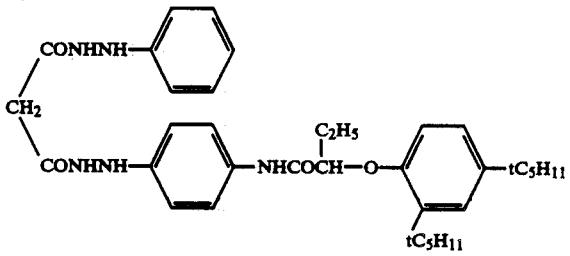
1-14
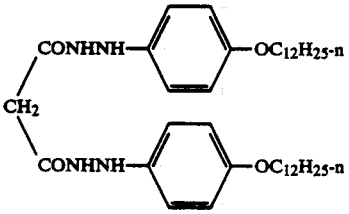

-continued
1-15
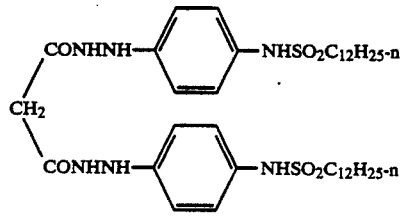
1-16
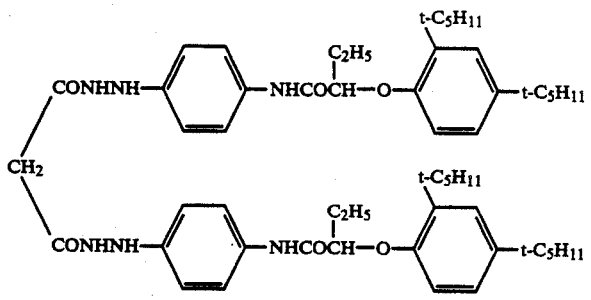
1-17
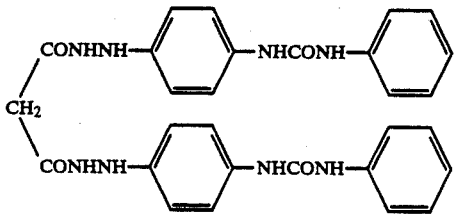
1-18
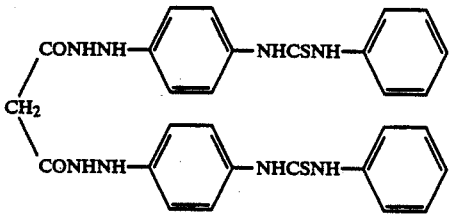
1-19
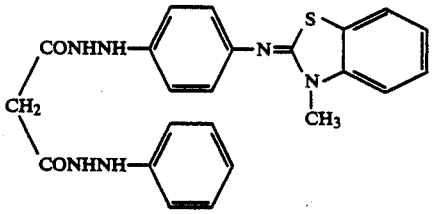
1-20
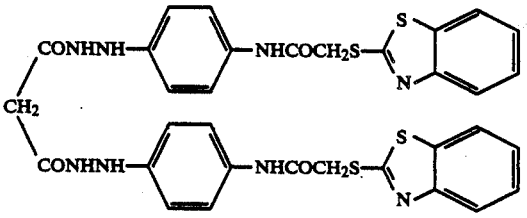
1-21
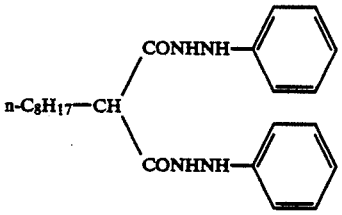

-continued
1-22
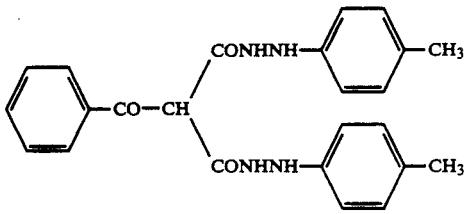
1-23
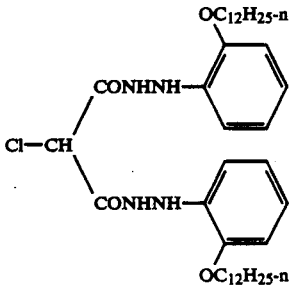
1-24
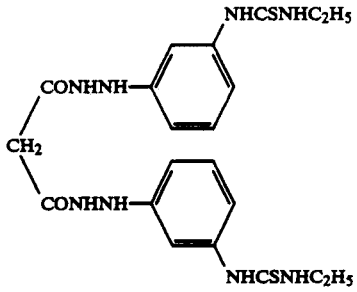
1-25
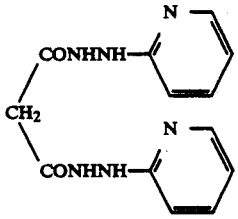
1-26
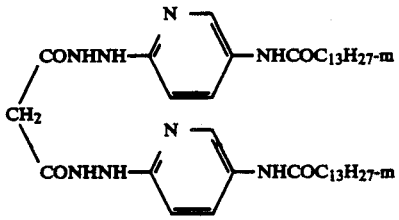
1-27
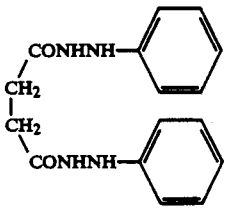

-continued
1-28
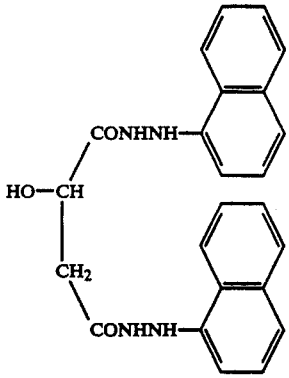
1-29
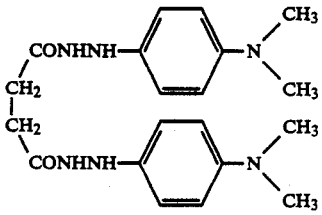
1-30
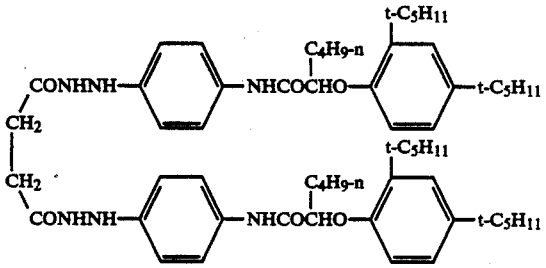
1-31
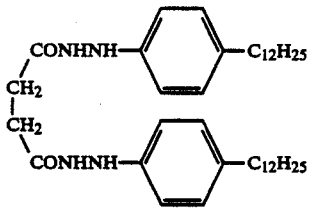
1-32
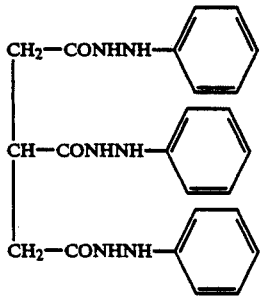

-continued
1-33
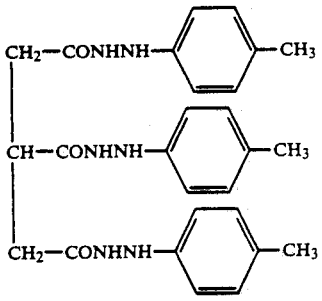
1-34
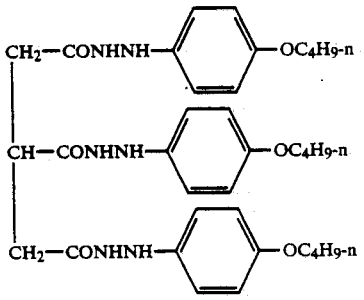
1-35
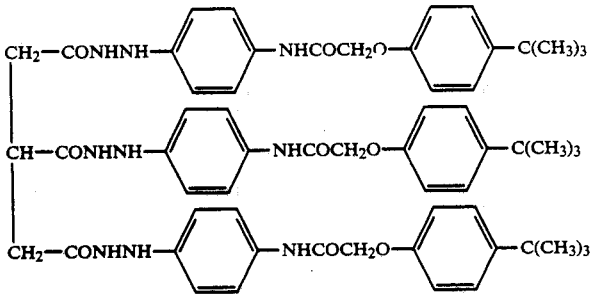
1-36
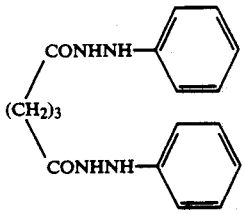
1-37
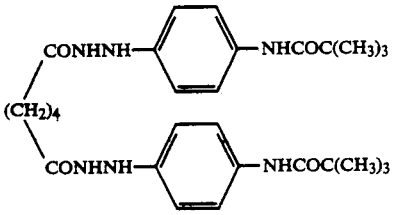
1-38
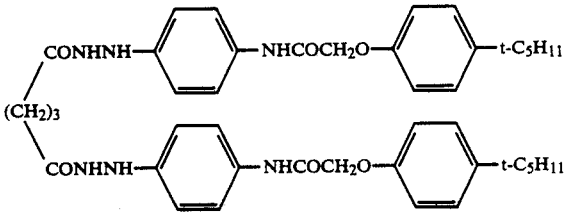

-continued
1-39
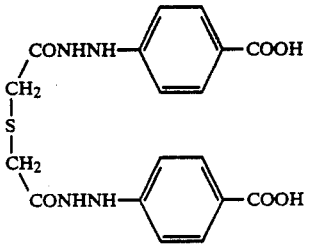
1-40
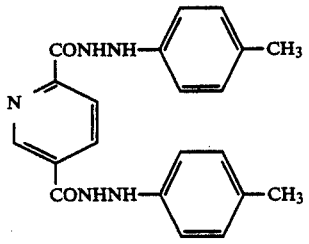
1-41
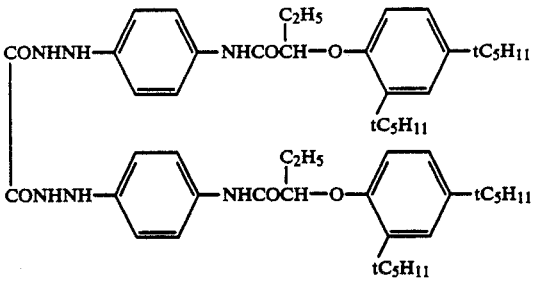
1-42
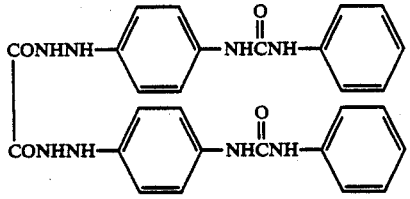
1-43
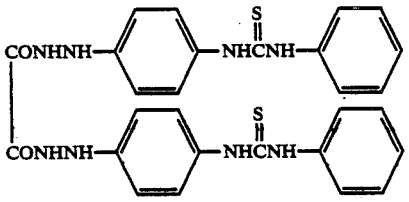
1-44
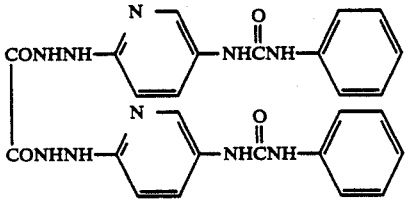

-continued
1-45
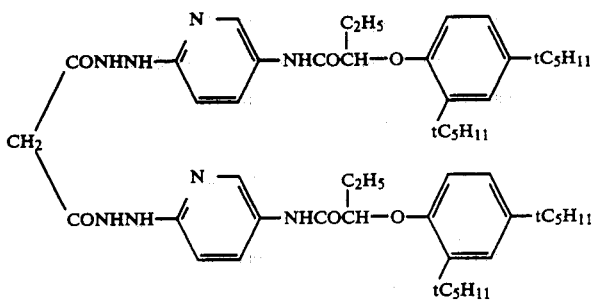
1-46
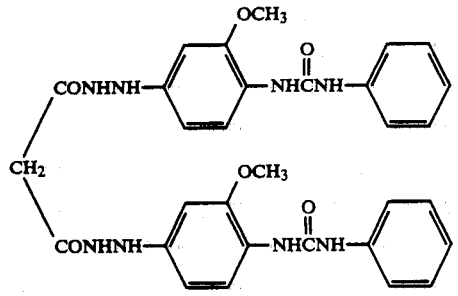
1-47
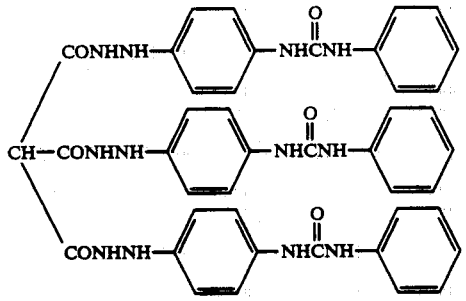
1-48
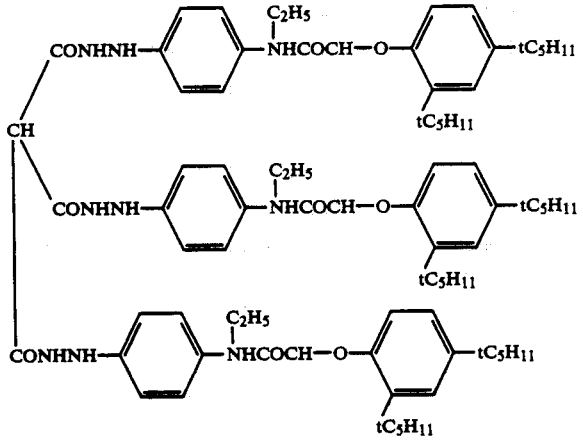
1-49
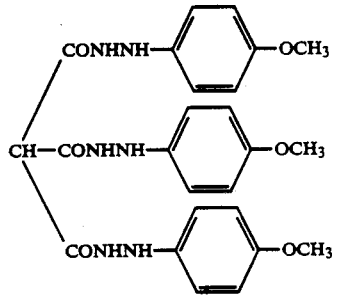

-continued
1-50
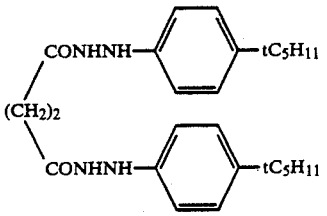
1-51
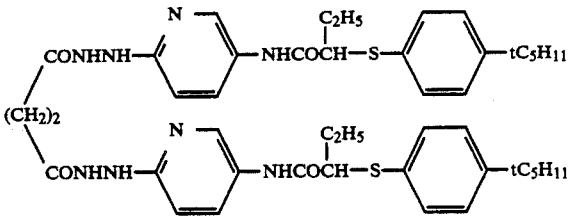
1-52
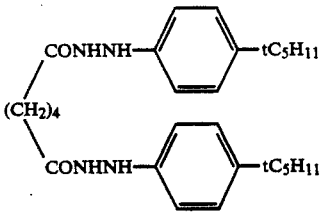
1-53
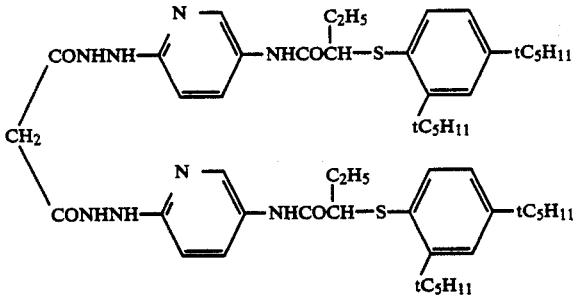
1-54
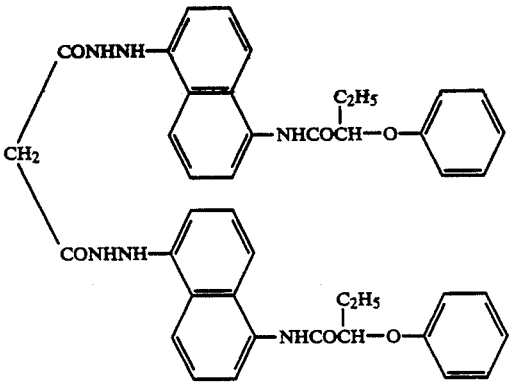

-continued 1-55

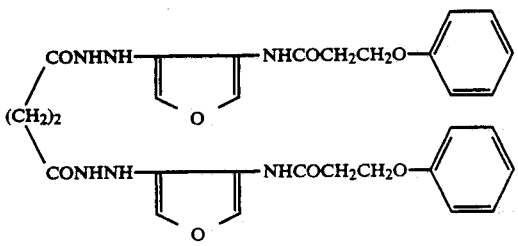

Formula 2

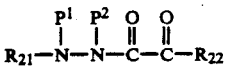

The aliphatic group represented by $R_2$ is preferably one having 6 or more carbon atoms, and particularly a straight-chain, branched-chain or cyclic alkyl group having from 8 to 50 carbon atoms, wherein the branched-chain alkyl group is allowed to be so cyclized as to form an unsaturated heterocyclic ring containing therein one or more hetero atoms. Also, this alkyl group includes one having such as an aryl, alkoxy or sulfoxy group.

The aromatic group represented by the $R_{21}$ is preferably a monocyclic or bicyclic aryl group or an unsaturated heterocyclic group, wherein the unsaturated heterocyclic group may be condensed with a monocyclic or bicyclic aryl group to form a heteroaryl group.

Examples of the ring of such cyclic groups include benzene ring, naphthylene ring, pyridine ring, pyrimidine ring, imidazole ring, pyrazole ring, quinoline ring, isoquinoline ring, benzimidazole ring, thiazole ring, benzothiazole ring, and the like. Out of these, those groups containing the benzene ring are preferred.

The most preferred as the $R_{21}$ is an aryl group.

The aryl group or unsaturated heterocyclic group represented by the $R_{21}$ includes one having a substituent, typical examples of which include straight-chain, branched-chain or cyclic alkyl groups such as those monocyclic or bicyclic ones of which the alkyl portion's number of carbon atoms is from 1 to 20; alkoxy groups having preferably from 1 to 20 carbon atoms; substituted amino group, preferably amino groups substituted by an alkyl group having from 1 to 20 carbon atoms; acylamino groups having preferably from 2 to 30 carbon atoms; sulfonamido groups having preferably from 1 to 30 carbon atoms; ureido groups having preferably from 1 to 30 carbon atoms; and the like.

Of those groups represented by the $R_{21}$ of Formula 2, the substitutable alkoxy group is one having from 1 to 20 carbon atoms, and may be substituted by a halogen atom, an aryl group or the like.

Of those groups represented by the $R_{21}$ of Formula 2, the substituted aryloxy group or heterocycloxy group is preferably monocyclic, and substituents to these groups include a halogen atom, alkyl group, alkoxy group, cyano group and the like.

In the case of the amino group, it is represented by

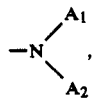

wherein $A_1$ and $A_2$ each represents a substitutable alkyl group or alkoxy group or may be a cyclic group of a structure containing —O—, —S— or —N— group linkage, provided that the $R_{22}$ is no hydrazino group.

The $R_{21}$ or $R_{22}$ of Formula 2 may be one into which is incorporated a ballasting group that is usually used in immobile photographic additives such as couplers. The ballasting group is a relatively photographically inactive group having 8 or more carbon atoms, which may be selected from among, for example, alkyl groups, alkoxy groups, phenyl group, alkylphenyl groups, phenoxy group, alkylphenoxy groups, and the like.

The $R_{21}$ or $R_{22}$ of Formula 2 may be one into which is incorporated a group that strengthens the adsorption to the silver halide grain surface. Examples of such the adsorption group include those groups as described in U.S. Pat. No. 4,355,105, such as thiourea group, heterocyclic thioamido group, mercapto heterocyclic group, triazole group, and the like.

Of those compounds having Formula 2, those represented by the following Formula 2-a are particularly preferred.

Formula 2-a

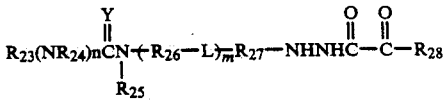

wherein $R_{23}$ and $R_{24}$ each represents a hydrogen atom, a substitutable alkyl group such as methyl, ethyl, butyl, dodecyl, 2-hydroxypropyl, 2-cyanoethyl, 2-chloroethyl or the like, substitutable phenyl group, naphthyl group, cyclohexyl group, pyridyl group, pyrrolidyl group, such as phenyl, p-methylphenyl, naphthyl, α-hydroxynaphthyl, cyclohexyl, p-methylcyclohexyl, pyrdiyl, 4-propyl-2-pyridyl, pyrrolidyl, 4-methyl-2-pyrrolidyl, etc.: $R_{25}$ is a hydrogen atom or a substitutable benzyl, alkoxy or alkyl group, such as benzyl, p-methylbenzyl, methoxy, ethoxy, ethyl, butyl; $R_{26}$ and $R_{27}$ each represents a divalent aromatic group such as phenylene or naphthylene; Y is a sulfur atom or oxygen atom; L is a divalent linkage group such as $—SO_2CH_2CH_2N—H—SO_2NH—$, $—OCH_2SO_2NH—$, —O—, —CH=N—; $R_{28}$ is a —NR'R" group or $—OR_{29}$ group wherein R', R" and $R_{29}$ each represents a hydrogen atom, a substitutable alkyl group such as methyl, ethyl, dodecyl, etc., a phenyl group such as phenyl, p-methylphenyl, p-methoxyphenyl, etc., or a naphthyl group such as α-naphthyl, β-naphthyl, etc.; and m and n each is an integer of zero or 1. When the $R_{28}$ represents $OR_{29}$, the Y represents preferably a sulfur atom.

The following are typical compounds represented by Formulas 2 and 2-a.

2-1
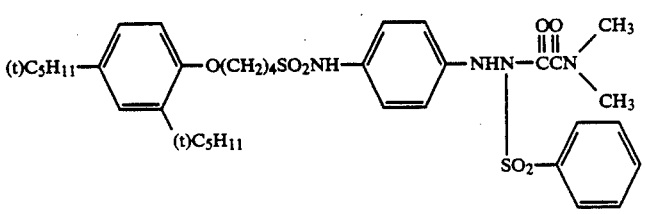
2-2
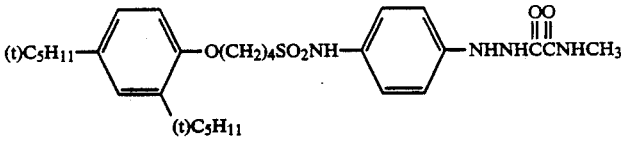
2-3
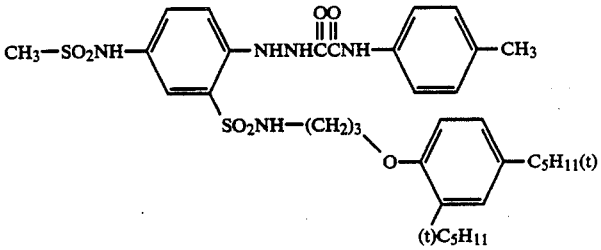
2-4
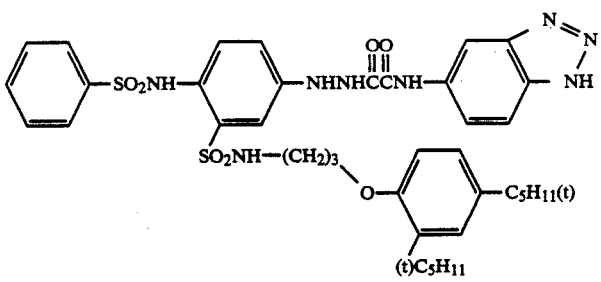
2-5
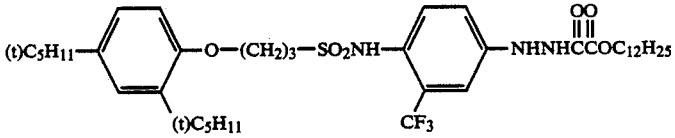
2-6
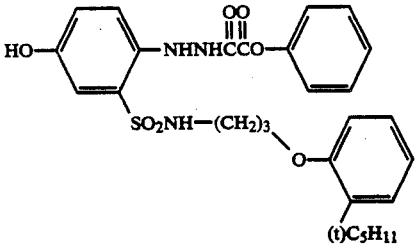
2-7
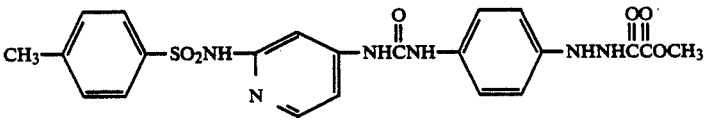
2-8
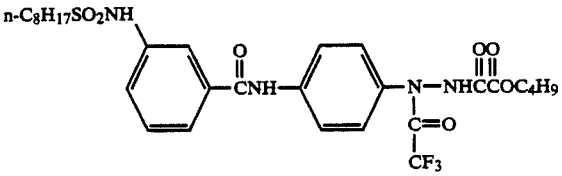

-continued
2-9
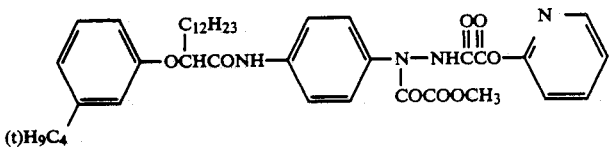
2-10
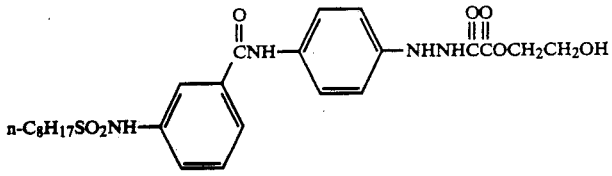
2-11
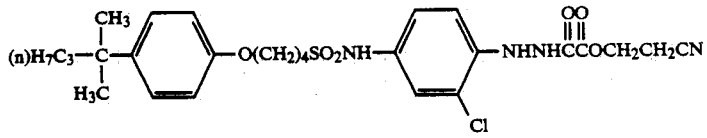
2-12
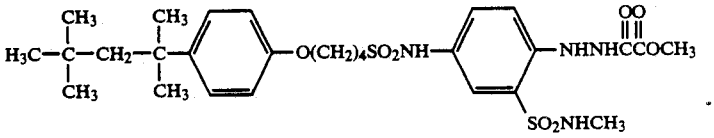
2-13
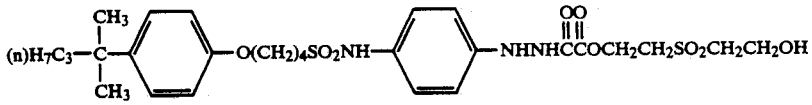
2-14
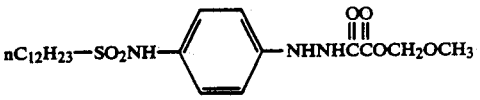
2-15
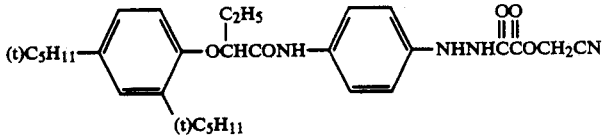
2-16
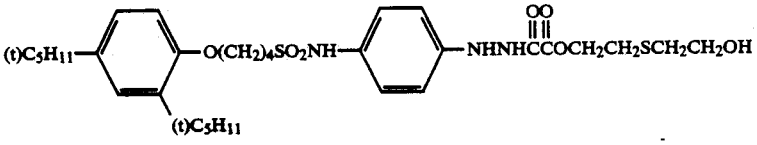
2-17
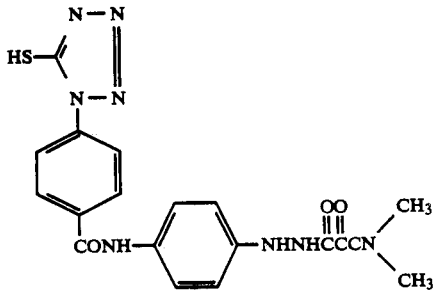

-continued
2-18
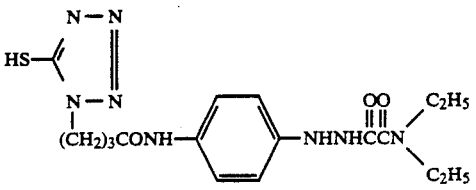
2-19
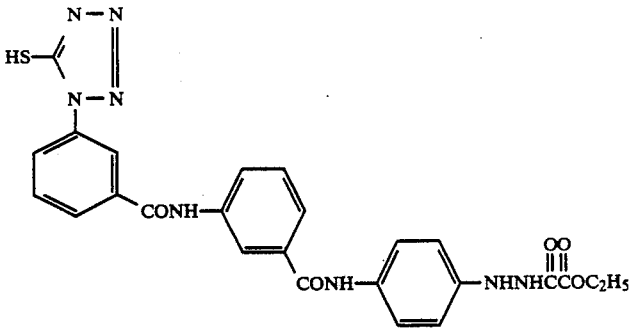
2-20
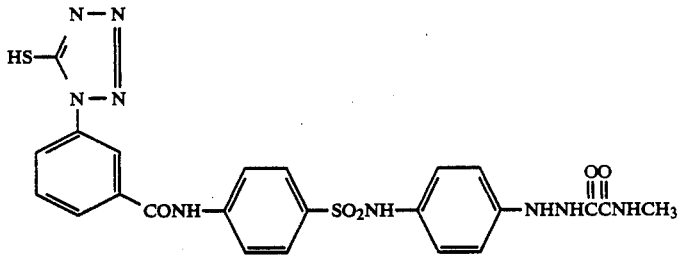
2-21
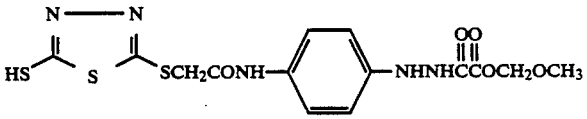
2-22
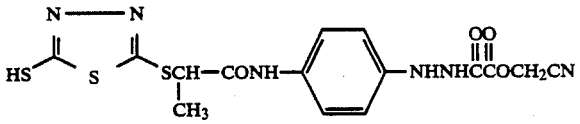
2-23
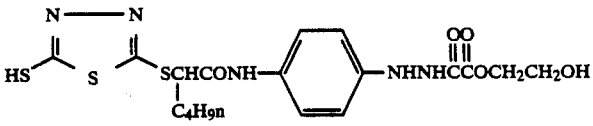
2-24
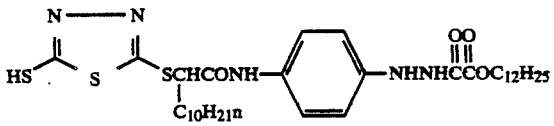
2-25
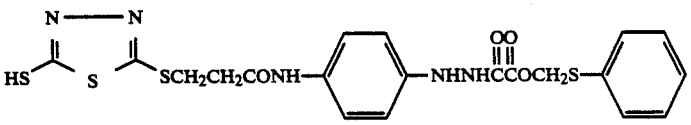
2-26
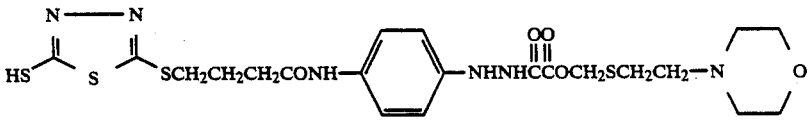

-continued
2-27
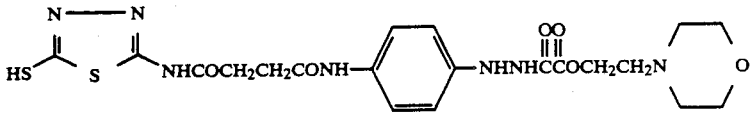
2-28
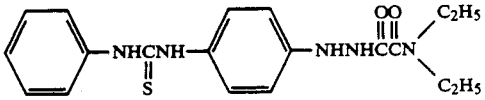
2-29
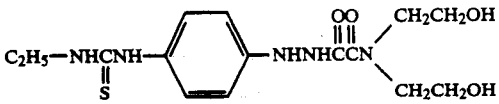
2-30
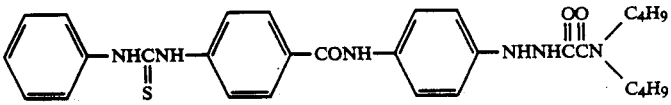
2-31
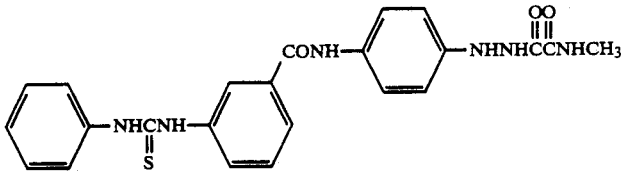
2-32
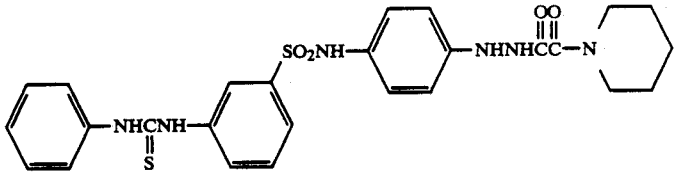
2-33
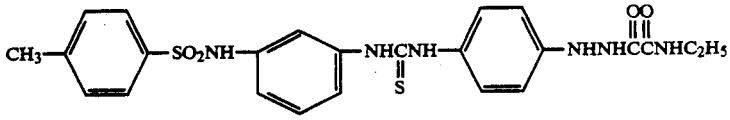
2-34
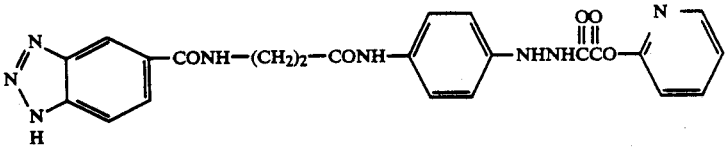
2-35
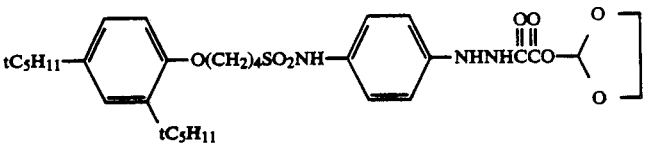
2-36
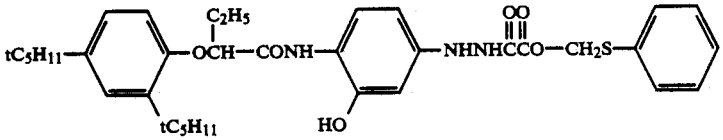
2-37
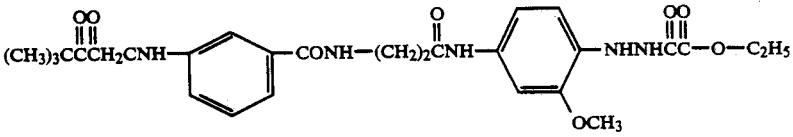

-continued
2-38
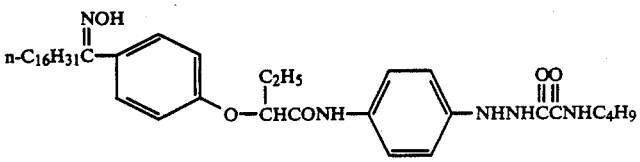
2-39
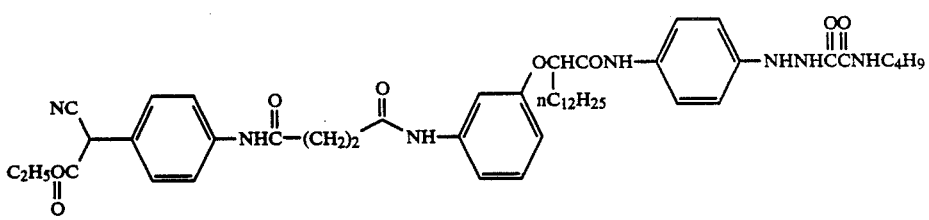
2-40
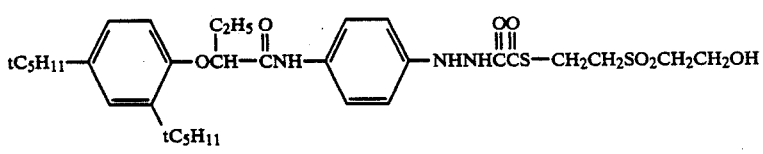
2-41
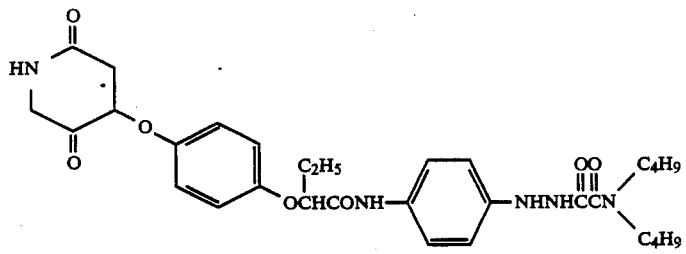
2-42
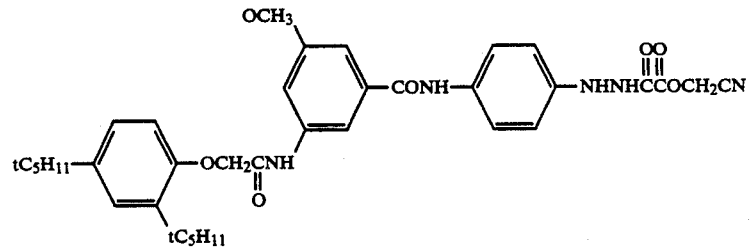
2-43
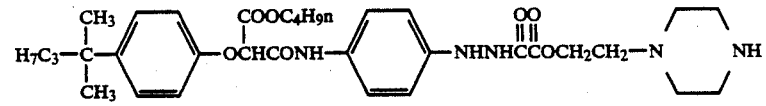
2-44
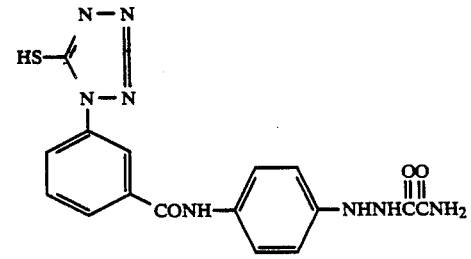
2-45
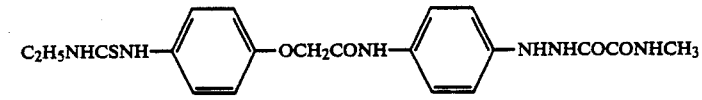

-continued
2-46
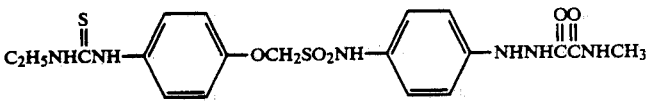
2-47
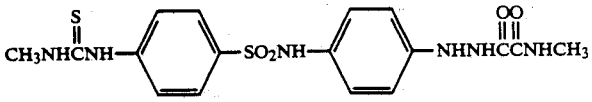
2-48
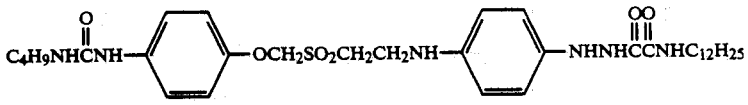
2-49
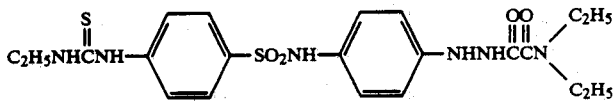
2-50
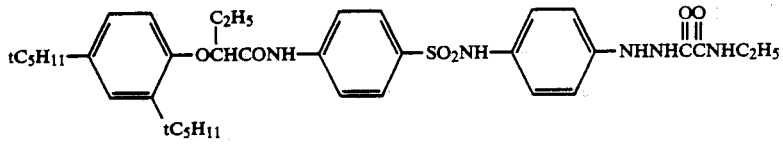
2-51
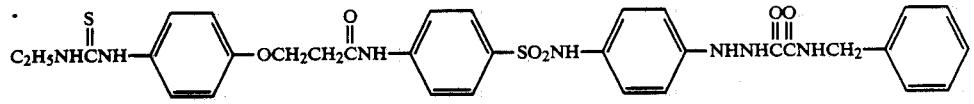
2-52
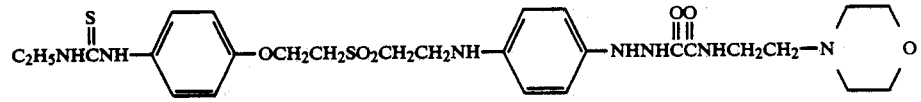
2-53
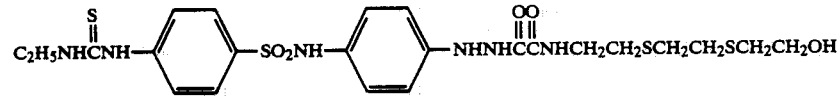
2-54
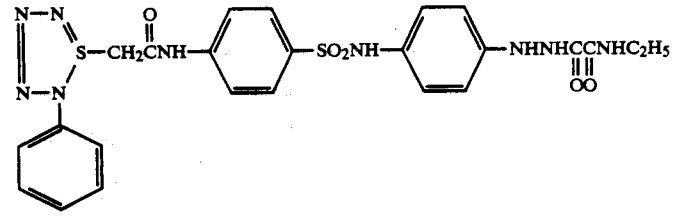
2-55
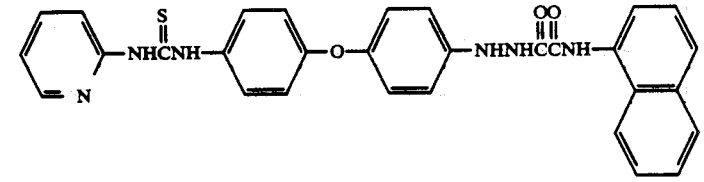
2-56
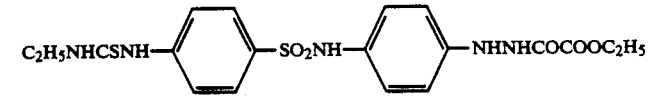
2-57
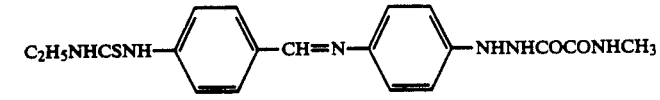

-continued 2-58

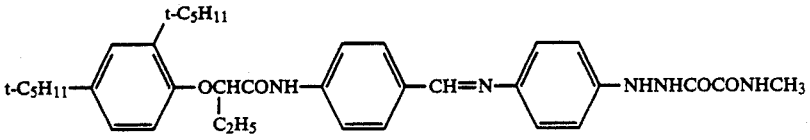

2-59

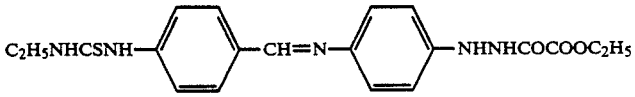

Subsequently, Compounds 2-45 and 2-47 out of the above exemplified compounds will be taken as examples to show their synthesis methods below:

Synthesis of Compound 2-45

Synthesis Scheme:

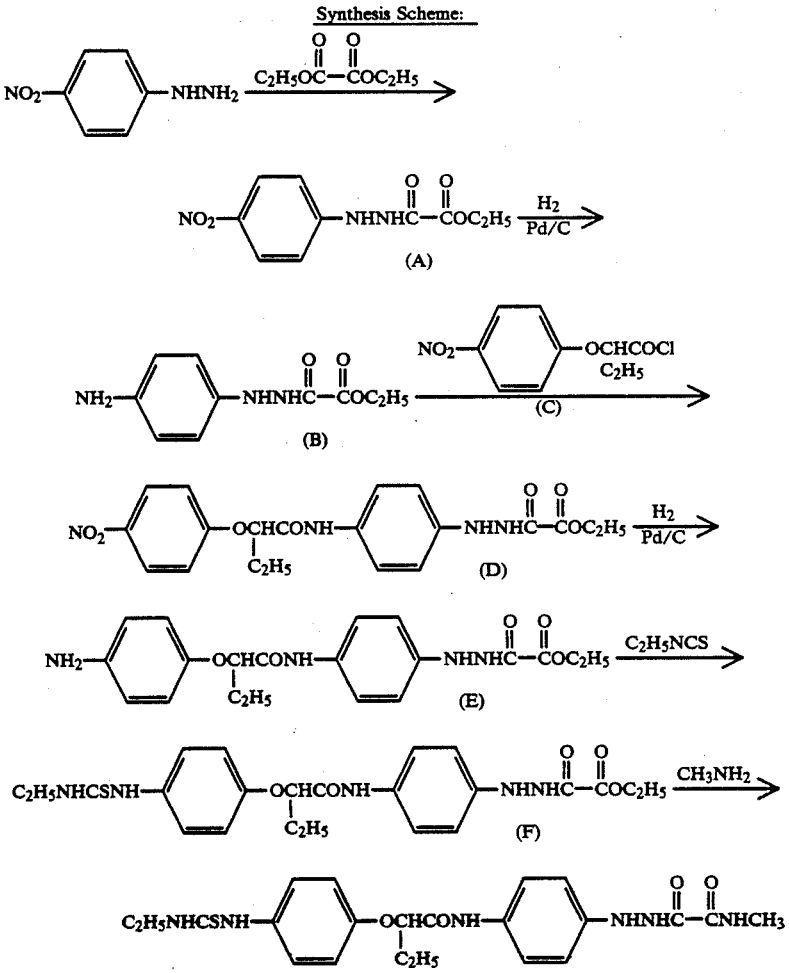

Compound 2-45

One hundred and fifty-three grams of 4-nitrophenylhydrazine and 500 ml of diethyl oxalate were mixed, and the mixture was refluxed for one hour. While the reaction was making progress, the ethanol was removed, and the reaction product was cooled to deposit crystals. The deposit was filtered and washed several times by using petroleum ether to be recrystallized. Then, 50 grams of the obtained crystals (A) were dissolved in 1000 ml of methanol by heating, and reduced under pressure of 50 p.s.i. in an $H_2$ atmosphere in the presence of a pd/C (palladium/carbon) catalyzer, whereby a compound (B) was obtained.

Twenty-two grams of this compound (B) were then dissolved into a mixture solution of 200 ml of acetonitrile and 16 grams of pyridine, and to this solution was dropwise added an acetonitrile solution of 24 grams of a compound (C) at room temperature. After filtering off insoluble matter, the filtrate was concentrated and recrystallized to be refined, whereby 31 grams of a compound (D) were obtained.

Thirty grams of the compound (D) were then hydrogenated in similar manner to the above, whereby 20 grams of a compound (E) were obtained.

Ten grams of the compound (E) were dissolved into 100 ml of acetonitrile, to the solution was added 3.0 grams of ethyl isothiocyanate, and the mixture was refluxed for one hour. After distilling off the solvent, the reaction product was recrystallized to be refined, whereby 7.0 grams of a compound (F) were obtained. Five point zero grams of the compound (F) were then dissolved into 50 ml of methanol, and to this were added 8 ml of an aqueous 40% methylamine solution, and the mixture liquid was stirred. After distilling off the methanol to concentrate the liquid to some extent, the deposited solid was taken out and recrystallized to be refined, whereby Compound 2-45 was obtained.

Synthesis of Compound 2-47

Synthesis Scheme:

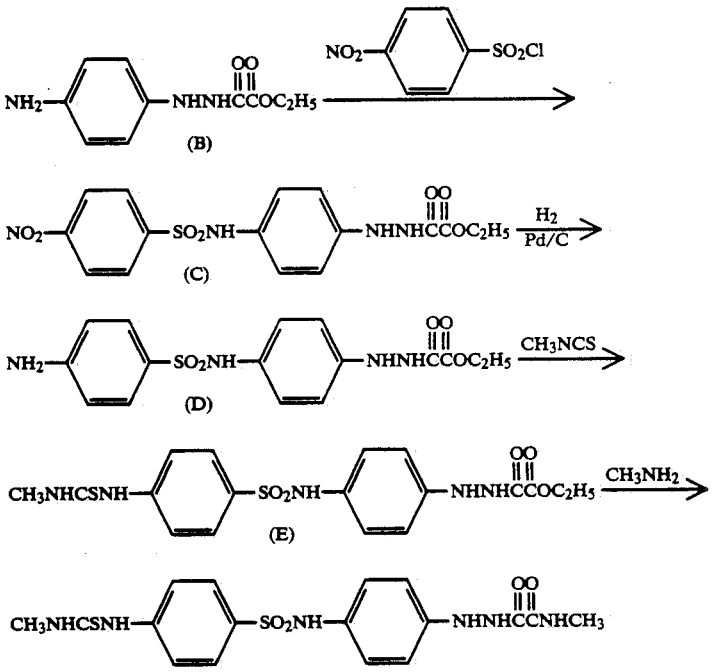

Compound 2-47

Twenty-two grams of the compound (B) were dissolved into 200 ml of pyridine, and to the solution, with stirring, were added 22 grams of p-nitrobenzenesulfonyl chloride. The resulting reaction mixture was poured into water, and the deposited solid was taken out to obtain a compound (C). From the compound (C) Compound 2-47 was obtained by similar reactions to those of Compound 2-45 in accordance with the synthesis scheme.

Subsequently, Formula 3 will be explained.

Formula 3

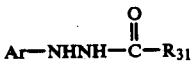

wherein Ar is an aryl group containing at least one nondiffusible group or silver halide adsorption accelerating group. As the nondiffusible group, a ballasting group that is usually used in immobile photographic additives such as couplers is preferred. The ballasting group is a relatively photographically inactive group having 8 or more carbon atoms, which may be selected from among, for example, alkyl groups, alkoxy groups, phenyl group, alkylphenyl groups, phenoxy group, alkylphenoxy groups, and the like.

Examples of the silver halide adsorption accelerating group include those groups as described in U.S. Pat. No. 4,385,108, such as thioureido group, thiourethano group, heterocyclic thioamido group, mercapto heterocyclic group, triazolyl group, and the like.

$R_{11}$ represents a substituted alkyl group. The alkyl group is a straight-chain, branched-chain or cyclic alkyl group, such as methyl, ethyl, propyl, butyl, isopropyl, pentyl, cyclohexyl or the like.

Examples of the substituent to be introduced to these alkyl groups include alkoxy groups such as methoxy, ethoxy, etc.; aryloxy groups such as phenoxy, p-chlorophenoxy, etc.; heterocycloxy groups such as pyridyloxy; mercapto group; alkylthio groups such as methylthio, ethylthio, etc.; arylthio groups such as phenylthio, p-chlorophenylthio, etc.; heterocyclic thio groups such as pyridylthio, pyrimidylthio, thiadiazolylthio, etc.; alkylsulfonyl groups such as methanesulfonyl, butanesulfonyl, etc.; arylsulfonyl groups such as benzenesulfonyl; heterocyclic sulfonyl groups such as pyridylsulfonyl, morpholinosulfonyl, etc.; acyl groups such as acetyl, benzoyl, etc. cyano group; chlorine; bromine; alkoxycarbonyl groups such as ethoxycarbonyl, methoxycarbonyl, etc.; aryloxycarbonyl groups such as phenoxycarbonyl; carboxy group; carbamoyl group; alkylcarbamoyl groups such as N-methylcarbamoyl, N,N-dimethylcarbamoyl, etc.; arylcarbamoyl groups such as N-phenylcarbamoyl; amino group; alkylamino groups such as methylamino. N,N-dimethylamino, etc.; arylamino groups such as phenylamino, naphthylamino, etc.; acylamino groups such as acetylamino, benzoylamino, etc.; alkoxycarbonylamino groups such as ethoxycarbonylamino; aryloxycarbonylamino groups such as phenoxycarbonylamino; acyloxy groups such as acetyloxy, benzoyloxy, etc.;

alkylaminocarbonyloxy groups such as methylaminocarbonyloxy; arylaminocarbonyloxy groups such as phenylaminocarbonyloxy; sulfo group; sulfamoyl group; alkylsulfamoyl groups such as methylsulfamoyl; arylsulfamoyl groups such as phenylsulfamoyl; and the like.

The hydrogen atom of the hydrazine may be substituted by a sulfonyl group such as methanesulfonyl, toluenesulfonyl, etc.; an acyl group such as acetyl, trifluoroacetyl, etc.; an oxalyl group such as ethoxalyl, or the like.

The following are typical compounds represented by the foregoing Formula 3.

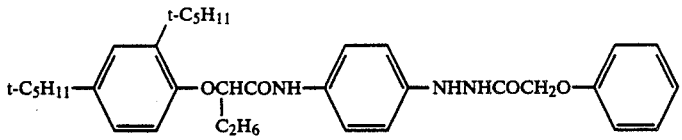

3-1

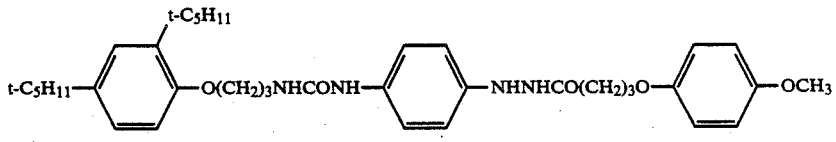

3-2

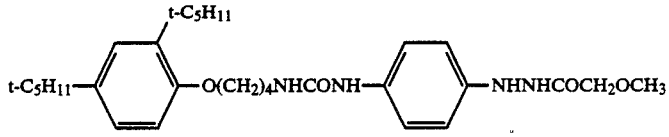

3-3

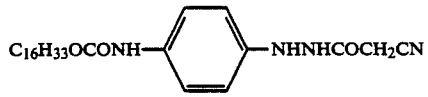

3-4

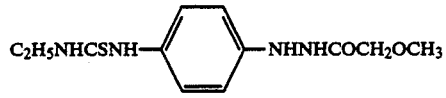

3-5

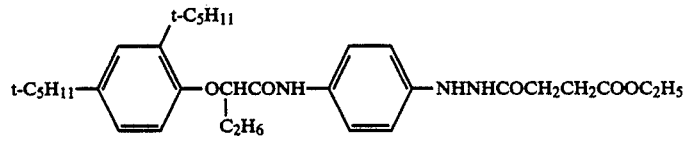

3-6

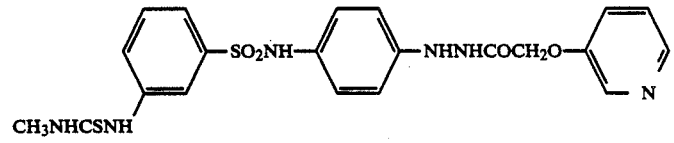

3-7

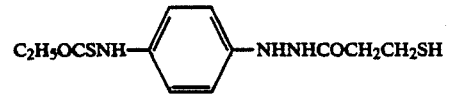

3-8

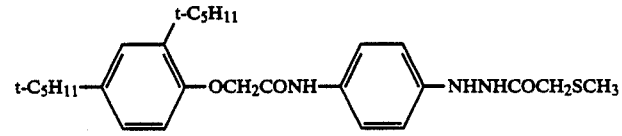

3-9

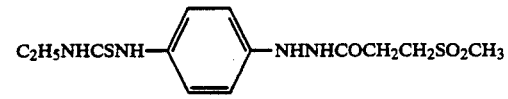

3-10

-continued
3-11
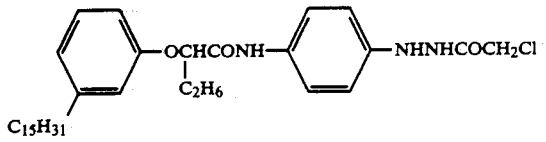
3-12
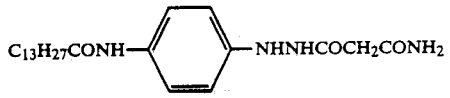
3-13
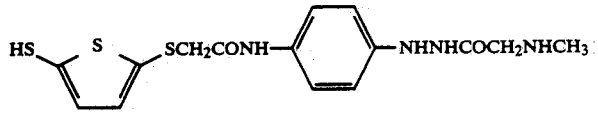
3-14
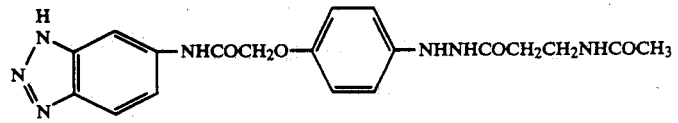
3-15
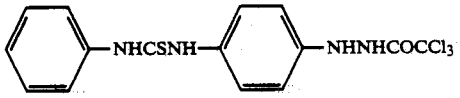
3-16
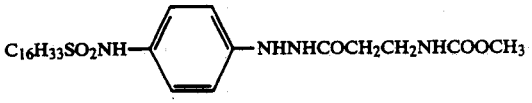
3-17
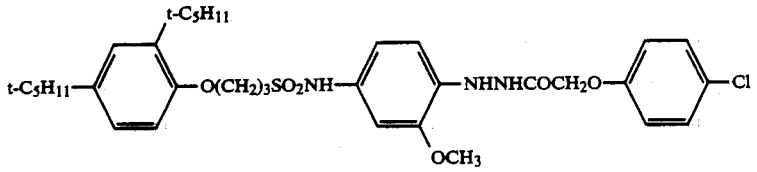
3-18
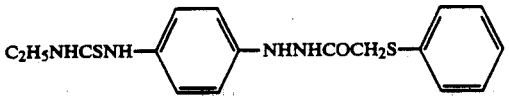
3-19
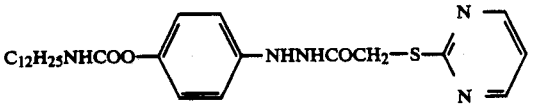
3-20
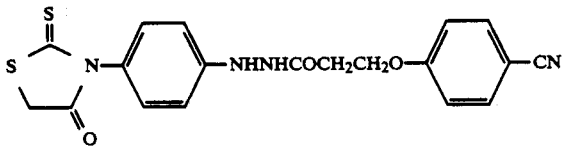
3-21
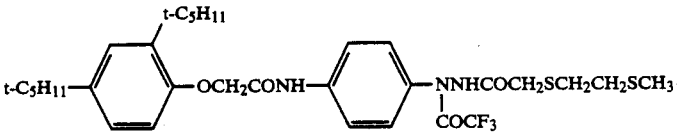

-continued
3-22
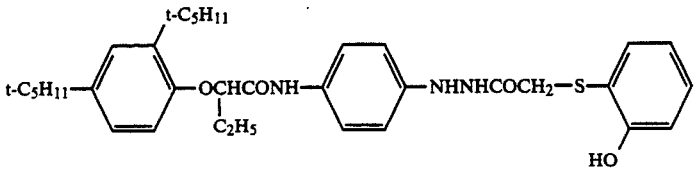
3-23
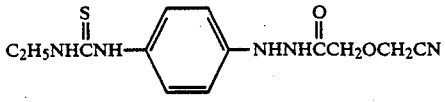
3-24
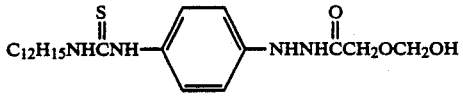
3-25
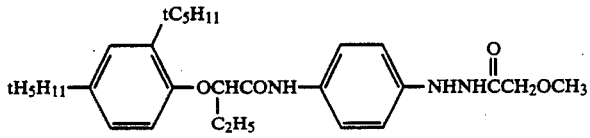
3-26
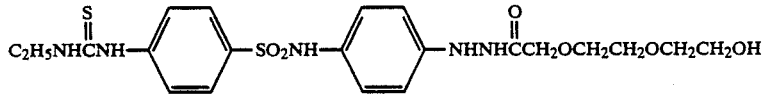
3-27
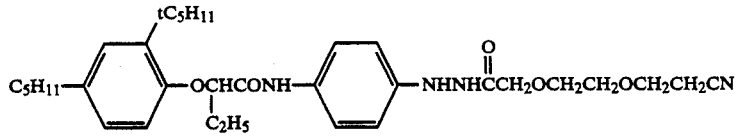
3-28
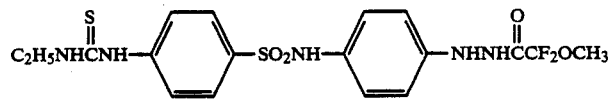
3-29
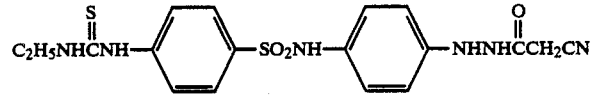
3-30
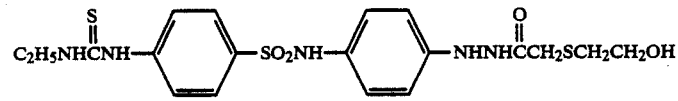
3-31
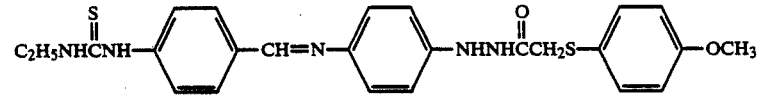
3-22
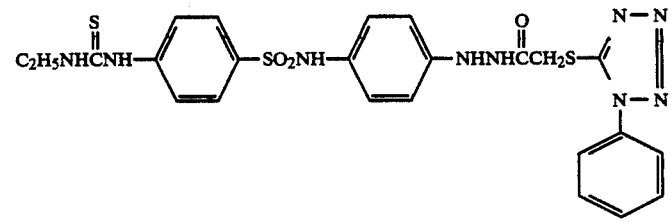
3-33
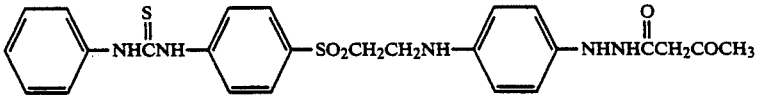

-continued
3-34
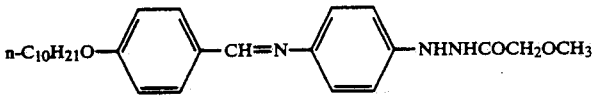
3-35
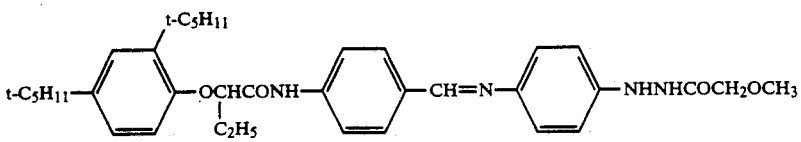
3-36
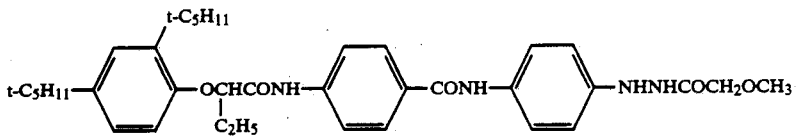
3-37
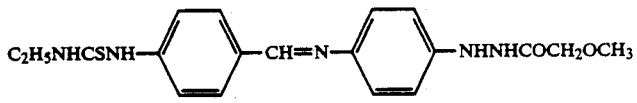
3-38
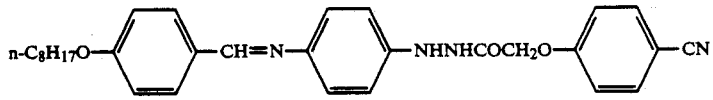
3-39
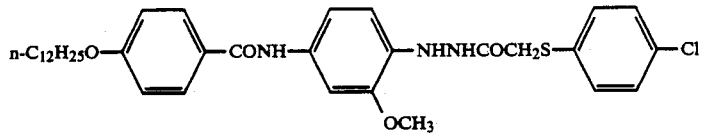
3-40
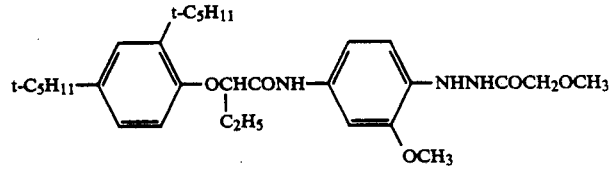
3-41
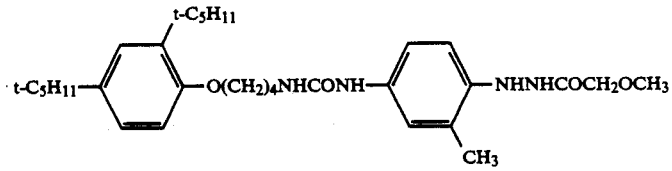
3-42
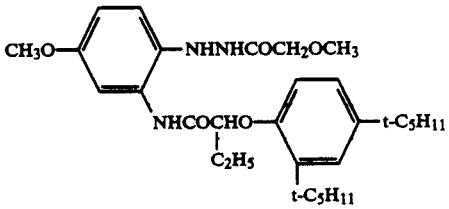
3-43
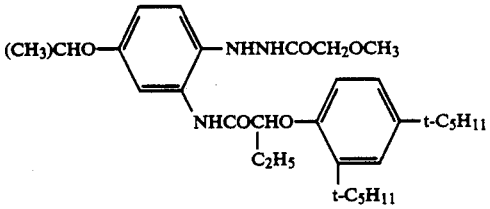

-continued
3-44
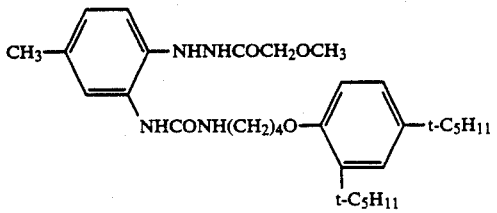
3-45
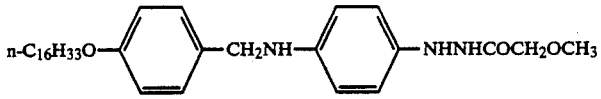
3-46
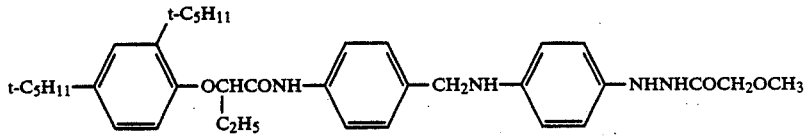
3-47
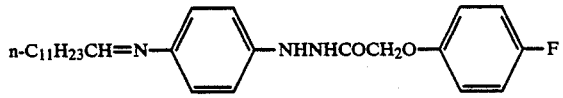
3-48
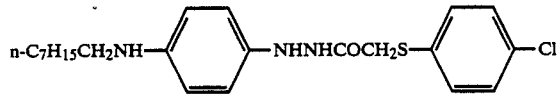
3-49
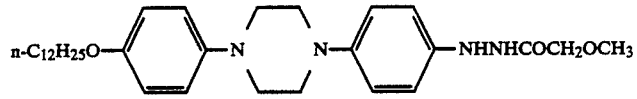
3-50
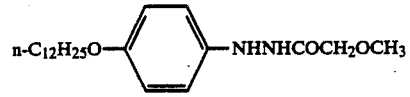
3-51
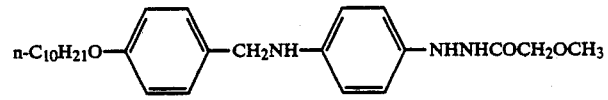
3-52
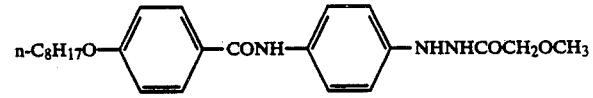
3-53
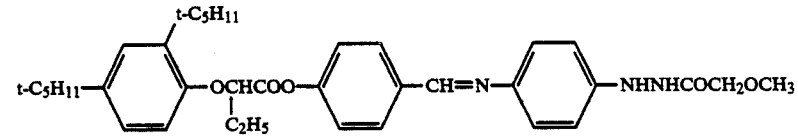
3-54
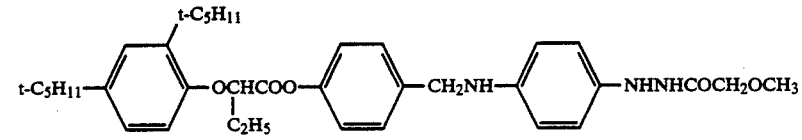
3-55
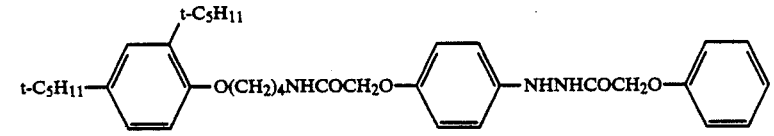

-continued
3-56
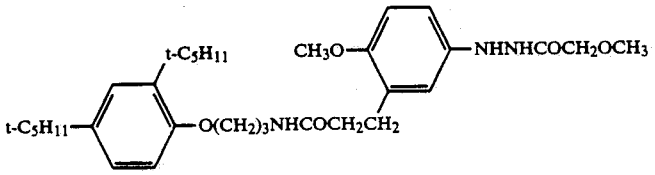
3-57
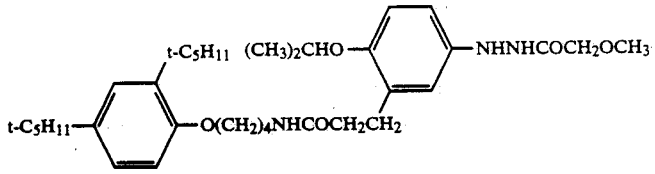
3-58
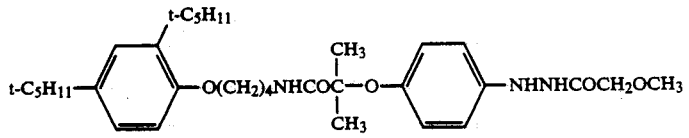
3-59
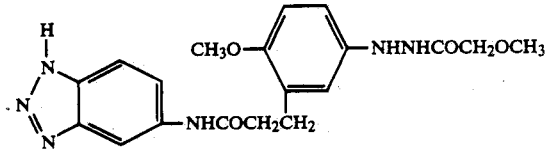
3-60
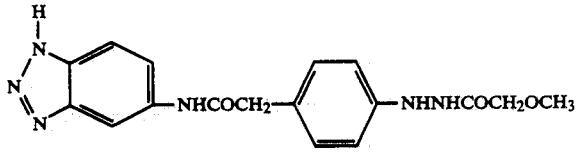
Synthesis examples of several of these compounds having Formula 3 will then be given below:
Synthesis of Compound 3-25
Synthesis Scheme:
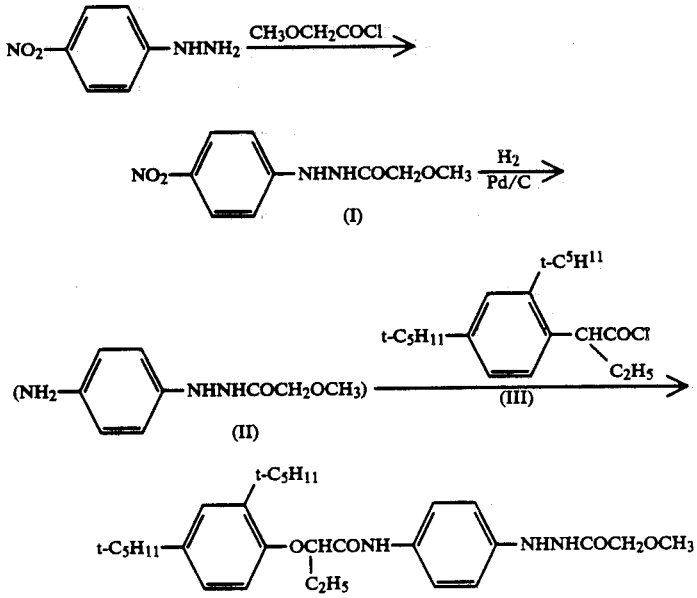
Compound 3-25
Fifteen point three grams (0.1M) of p-nitrophenylhydrazine were dissolved into 75 ml of acetonitrile, and to this solution, while being cooled by ice, were added dropwise 16.3 g (0.15M) of methoxyacetyl chloride, and then added dropwise 15.2 g (0.15M) of triethylamine. After completion of the dropwise addition, the reaction liquid was poured into 750 ml of water, then the aqueous solution was neutralized by an aqueous sodium hydroxide solution, and the thereby deposited crystals were filtered and then dried, whereby 15.5 g of a methoxyacetyl compound (I) were obtained: Yield: 70%.

Fifteen point five grams of the methoxyacetyl compound (I) (0.07M) and 3.0 g of palladium carbon catalyst were added to 120 ml of acetic acid, and this mixture was vigorously stirred under normal pressure in a hydrogen gas current at room temperature. About five hours later, the adsorption of the hydrogen gas was completed to have the reaction come to an end. The reaction liquid was then filtered to remove the catalyst therefrom. To the filtrate were added 14.0 g of potassium acetate, and to this were dropwise added 20.7 g (0.06M) Of 2-(2',4'-di-t-pentyl)phenoxybutyryl chloride (III) at room temperature. After that, the reaction liquid was poured into 1 liter of water, and the separated oily phase was decanted and dissolved into 300 ml of chloroform, and then washed by dilute alkaline water. The separated chloroform phase was dehydrated by adding MgSO thereto and then filtered. The filtrate was then concentrated to thereby obtain 27 g of a crude product. This was refined by column chromatography (200 g of silica, chloroform:ethyl acetate=100:1), whereby 16.6 g of Compound 3-25 were obtained: Yield: 50%, melting point: 50.8° to 52.0° C.

Synthesis of Compound 3-3

Synthesis Scheme:

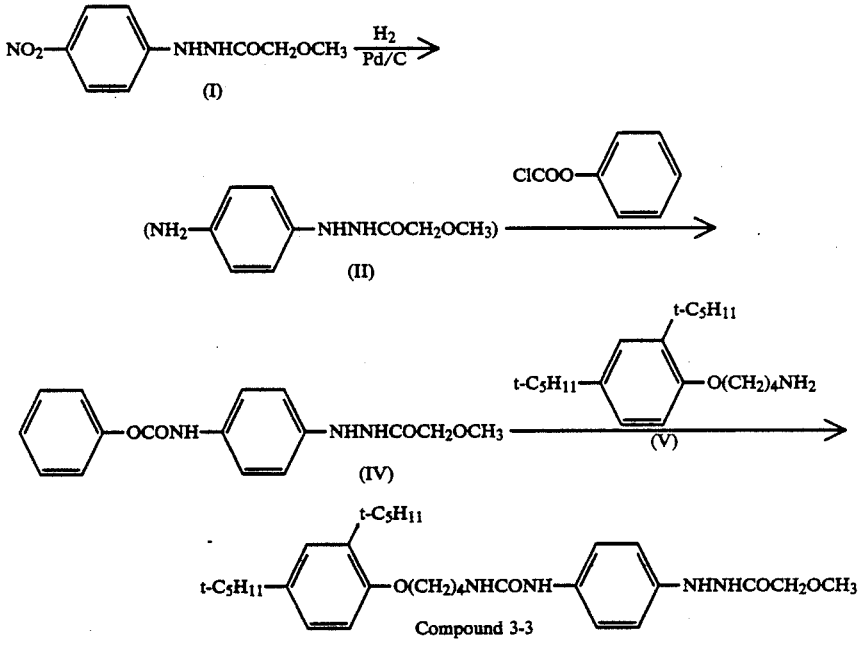

In the same manner as in the foregoing synthesis method for Compound 3-25, 9.4 g (42 mM) of methoxyacetyl compound (I) were used to effect reactions, whereby a compound (II) was synthesized, and after filtering off the catalyst residuum, into the filtrate were dissolved 50 ml of acetic acid and 3.5 g (42 mM) of sodium acetate, and then to the solution, while being cooled to 15° C. or lower, were added dropwise 6.6 g (42 mM) of phenyl chloroformate. Further, the reaction liquid, after being stirred for 10 minutes at room temperature, was poured into 500 ml of iced water, then neutralized by sodium carbonate, and then extracted by chloroform. The chloroform phase was washed by water, dehydrated by $MgSO_4$, then filtered, and then concentrated, whereby 9.3 g of crude product were obtained. This product was washed by a solvent (acetonitrile:ethyl acetate:hexane=10:5:1) with stirring thereby to be refined, whereby 7.4 g of a phenyl ester compound (IV) were obtained: Yield: 78%.

To 560 ml of toluene were added 7.4 g (23 mM) of the phenyl ester compound (IV), 0.2 g of imidazole and 8.4 g (28 mM) of 4-(2',4'-di-t-pentylphenoxy)-n-butylamine (V), and the mixture was refluxed by heating with stirring for 1.5 hours. After that, the reaction liquid was concentrated, whereby 16.2 g of a residuum were obtained. This product was subsequently refined by column chromatography (200 g of silica, chloroform:ethyl acetate=100:1), whereby 9.9 g of Compound 3-3 were obtained: Yield: 82%.

Synthesis of Compound 3-5

Synthesis Scheme:

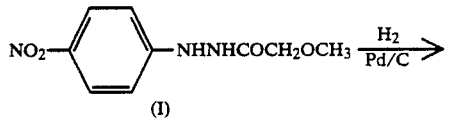

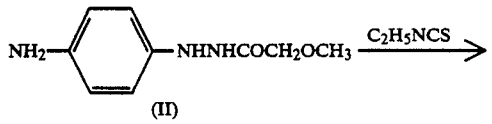

-continued

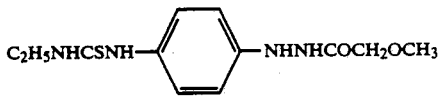

Compound 3-5

In the same manner as in the synthesis method for Compound 3-25, 11.6 g (52 mM) Of the methoxyacetyl compound (I) were used to effect reactions, and the catalyst residuum was filtered off. The filtrate was concentrated, the produced residuum was dissolved into 460 ml of ethyl acetate, this solution was neutralized by anhydrous potassium carbonate, and the insoluble matter was filtered off. The filtrate was dehydrated by $MgSO_4$, filtered, and then concentrated, whereby 9.7 g of a crude product were obtained. This product was recrystallized in chloroform to be refined, whereby 6.2 g of an amino compound (II) were obtained: Yield: 61%.

Six point two grams (32 mM) of the amino compound (II) were dissolved into 60 ml of acetonitrile, and to this solution, under a reflux-by-heating condition, were dropwise added 4.1 g (47 mM) of ethyl isothiocyanide, and, after the dropwise addition, the reflux was further continued for two hours. After the reaction liquid was cooled to 5° C. or lower, the deposited matter was filtered, and then dried, whereby 4.5 g of a crude product were obtained. This was recrystallized in acetone to be refined, whereby 3.9 g of Compound 3-5 were obtained: Yield: 43%, melting point: 164.2° to 165.0° C.

Synthesis of Compound 3-34

Synthesis Scheme:

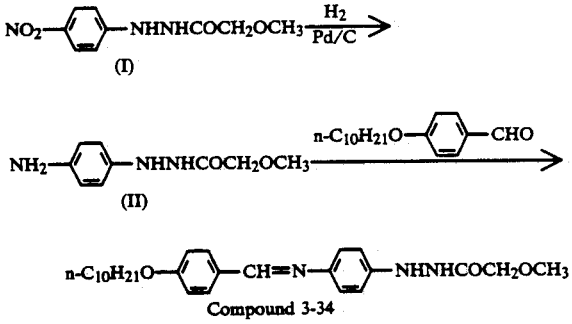

Compound 3-34

Ten grams of Compound (I) and 2.0 g of a 5% palladium carbon catalyst were added to 80 ml of ethanol, and this mixture was vigorously stirred, thereby having the compound absorb a theoretical amount of H'. The catalyst was filtered off, the filtrate was then concentrated, and to the residuum were added 50 ml of ethanol, and further were dropwise added at 15° C. or lower 14.4 g of p-n-decyloxybenzaldehyde. The reaction of the liquid lasted overnight in a nitrogen gas current. The deposited crystals were filtered, and washed twice by isopropyl ether, whereby 16.0 g of a crude product were obtained. Six grams of the crude product were recrystallized in 30 ml of benzene, whereby 5.5 g of Compound 3-34 were obtained: Melting point: 127° to 127.5° C.

Synthesis of Compound 3-51

Synthesis Scheme:

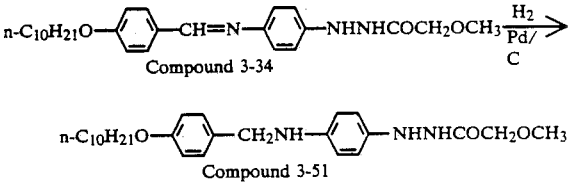

Compound 3-51

Eight point five grams of Compound 3-34 and 1.2 g of a 5% palladium-carbon catalyst were added to 77 ml of ethanol to thereby have the compound absorb a theoretical amount of $H_2$. Ethanol was added to the reaction liquid to dissolve the deposited crystals therein, then the catalyst was filtered off, the filtrate was dried up, and the residuum was recrystallized from isopropyl ether/methanol, whereby 5.9 g of Compound 3-51 were obtained: Melting point: 86° to 87° C.

Synthesis Of Compound 3-52

Synthesis Scheme:

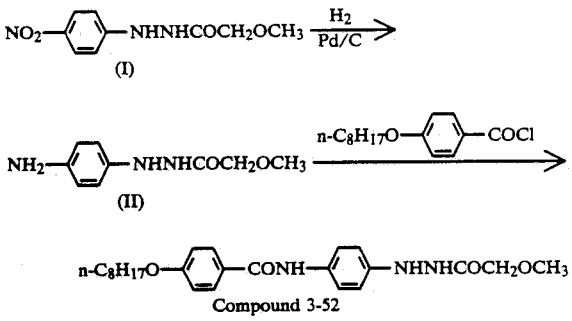

Compound 3-52

Nine point four grams of Compound (I) and 1.8 g of a 5% palladium-carbon catalyst were added to 50 ml of acetic acid to thereby have the compound absorb a theoretical amount of $H_2$. After the reaction, the catalyst was filtered off, and to the filtrate were added 3.5 g of sodium acetate. To the mixture were then dropwise added at 15° C. or lower 11.3 g of p-octyloxybenzoyl chloride, and their reaction lasted overnight at room temperature. After that, the reaction liquid was poured into 500 ml of water, and to this was added $CHCl_3$ in order to restrain the liquid from foaming, and the liquid was neutralized by $NaHCO_3$. The deposited crystals were filtered, then dried, and then recrystallized from isopropyl ether/methanol, whereby 8.2 g of Compound 3-52 were obtained: Melting point: 183° to 184° C.

In the method of this invention, the hydrazide compound having Formula 1, 2 or 3 should be contained in the light-sensitive material and/or a developer solution. In the case of incorporating the compound into the light-sensitive material, the compound should be incorporated into a light-sensitive silver halide emulsion layer containing a 3-pyrazolidone compound and a di- or trihydroxybenzene-type compound and/or at least one of other layers on the support from which the compound can be diffused to move into the emulsion layer at least by the time of development. In this instance, the amount of the hydrazide compound is preferably from $1\times10^{-6}$ to $1\times10^{-1}$ mole, and more preferably from $1\times10^{-4}$ to $1\times10^{-2}$ mole per mole of silver halide. Its suitable amount may be discretionarily determined, taking into account the composition, grain sizes and degree of chemical ripening of the silver halide to be used, the amount of a hydrophilic colloid as the binder of layers, and its balance with additives such as stabilizer, restrainer, accelerating agent, and the like.

In the case of incorporating the hydrazide compound into a developer solution, its adding amount is from $10^{-5}$ to $10^{-2}$ mole, and preferably from $10^{-4}$ to $10^{-3}$ mole per liter of the developer solution, and its suitable amount may be determined, taking into account its balance with the amino compound to be present together, pH, antifoggant, and the like.

The 3-pyrazolidone compound to be contained in the light sensitive material for use in the method of this invention is a compound having the following Formula:

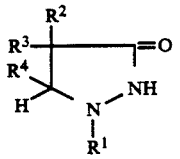

wherein $R^1$ is a substitutable aryl group; $R^2$, $R^3$ and $R^4$ each represents a hydrogen atom or a substitutable alkyl group. The substituent to the aryl group represented by the $R^1$ is, for example, a methyl, chloro, amino, methylamino, acetylamino., methoxy or methylsulfonamidoethyl group. The aryl group represented by the $R^1$ is, for example, a phenyl, p-aminophenyl, p-chlorophenyl, p-acetamidophenyl, p-methoxyphenyl, or the like group.

The alkyl group represented by the $R^2$, $R^3$ or $R^4$ may be in any of the straight-chain, branched-chain or cyclic form, and is preferably one having from 1 to 8 carbon atoms and being allowed to have a substituent such as, e.g., a hydroxy, carboxy, sulfo or the like group. The alkyl group is such as, for example, a methyl, hydroxymethyl, ethyl or propyl group.

Typical examples of the above-mentioned 3-pyrazolidone compound are as follows:

A-1: 1-phenyl-3-pyrazolidone
A-2: 1-phenyl-4,4-dimethyl-3-pyrazolidone
A-3: 1-phenyl-4-methyl-4-hydroxymethyl-3-pyrazolidone
A-4: 1-phenyl-4,4-di(hydroxymethyl)-3-pyrazolidone
A-5: 1-phenyl-5-methyl-3-pyrazolidone
A-6: 1-phenyl-4,4-dimethyl-3-pyrazolidone
A-7: 1p-aminophenyl-4-methyl-4-propyl-3-pyrazolidone
A-8: 1-p-chlorophenyl-4-methyl-4-ethyl-3-pyrazolidone
A-9: 1-p-acetamidophenyl-4,4-diethyl-3-pyrazolidone
A-10: 1-p-methoxyphenyl-4,4-diethyl-3-pyrazolidone The position of the compound inside the light-sensitive material is to be in the light-sensitive silver halide emulsion layer, but may also be in non-emulsion layers such as the protective layer, intermediate layer, subbing layer, backing layer, etc. Incorporation of the compound should be made generally in the form of a solution of it dissolved in an organic solvent. Its adding amount is from $10^{-6}$ to $10^{-1}$ mole per mole of silver halide, but when it is in the range of from $10^{-4}$ to $10^{-2}$ mole, the best results can be obtained.

The di- or trihydroxybenzene compound to be contained in the light-sensitive material and developer solution for use in the image forming method of this invention is a compound having the formula:

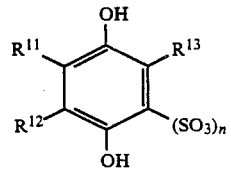

wherein $R^{11}$, $R^{12}$ and $R^{13}$ each represents a hydrogen atom, a halogen atom, an alkyl group or a substituted alkyl group, an aryl group or a substituted aryl group, a heterocyclic group or a substituted heterocyclic group, a —O—$R^{14}$ group, or a —S—$R^{14}$ group, wherein $R^{14}$ is a hydrogen atom, an alkyl group or a substituted alkyl group, an aryl group or a substituted aryl group, or a heterocyclic group or a substituted heterocyclic group; and n is an integer of zero or 1.

Typical examples of the above di- or trihydroxybenzene-type compound are as follows:

B-1: Hydroquinone
B-2: Chlorohydroquinone
B-3: Bromohydroquinone
B-4: Methyl-hydroquinone
B-5: 2,3-dichlorohydroquinone
B-6: 2,5-dibenzoylaminohydroquinone
B-7: Butyl gallate
B-8: Ethyl gallate The position of the compound inside the light-sensitive material of this invention is to be in the light-sensitive silver halide emulsion layer, but may also be in non-emulsion layers such as the protective layer, intermediate layer, subbing layer, backing layer, etc. Incorporation of the compound should be made generally in the form of a solution of it dissolved in water or an organic solvent including alcohols such as methanol, ethanol, etc.; glycols such as diethylene glycol, triethylene glycol, etc.; ketones such as acetone; or the like. Its adding amount is from 0.001 to 0.10 mole per mole of silver halide, and preferably from 0.005 to 0.03 mole.

As the dihydroxybenzene-type compound to be contained in a developer solution for use in the method of this invention, hydroquinone, widely used in general photographic processing, is most preferred, and its adding amount is normally from 0.05 to 0.5 mole per liter.

The sulfite to be contained in the developer solution for use in the method of this invention may be one that is usually used in developer solutions for use in developing ordinary silver halide photographic light-sensitive materials, and examples of it include sodium sulfite, potassium sulfite, lithium sulfite, ammonium sulfite, sodium bisulfite, potassium metabisulfite, addition compound of formaldehyde with sodium bisulfite, and the like. The sulfite's concentration need only be such a concentration as to protect the developer solution from air oxidation to thereby enable to obtain a sufficient sulfite ion concentration for providing stable photographic characteristics, and thus its adding amount needs to be not less than 0.05 mole per liter, and preferably more than 0.15 mole per liter.

The amino compound to be contained in the developer solution for use in the method of this invention is used for the purpose of accelerating the increase in image contrast; particularly, of enhancing its effect even on a relatively low pH level of the developer solution. Those useful amino compounds for this invention include inorganic amines and organic amines. The organic amine can be an aliphatic amine, aromatic amine, cyclic amine, aliphatic-aromatic mixture amine, or heterocyclic amine. Primary amines, secondary amines, tertiary amines and quaternary ammonium compounds have been all found out to be effective.

Alkanolamines particularly suitable for object of this invention have the formula:

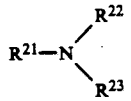

wherein $R^{21}$ is a hydroxyalkyl group having 2 to 10 carbon atoms; $R^{22}$ and $^{23}$ each represents a hydrogen atom, an alkyl group having 1 to 10 carbon atoms, a hydroxyl group having 2 to 10 carbon atoms, a benzyl group or a group having the formula:

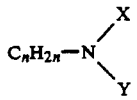

wherein n is an integer of 1 to 10, and X and Y each is a hydrogen atom, an alkyl group having 1 to 10 carbon atoms or a hydroxyalkyl group having 2 to 10 carbon atoms.

Different-type amino compounds also suitable are alkylamines; particularly those having the formula:

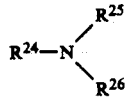

wherein $R^{24}$ is an alkyl group having 1 to 10 carbon atoms; and $R^{25}$, and $R^{26}$ each represents a hydrogen atom or an alkyl group having 1 to 10 carbon atoms.

Among a large number of amino compounds usable in practicing this invention, those particularly typical ones will be exemplified below:

C-1: Triethanolamine
C-2: Diethanolamine
C-3: Ethanolamine
C-4: 2-Diethylamino-1-ethanol
C-5: 2-Methylamino-1-ethanol
C-6: Diethylamino-1-propanol
C-7: 5-Amino-1-1 -pentanol
C-8: Diethanolamine
C-9: Triethylamine
C-10: Diisopropylamine
C-11: 2-Dibutylaminoethanol
C-12: 1-4-Cyclohexane-bis(methylamine)
C-13: o-Aminobenzoic acid
C-14: Aminoguanidine sulfate
C-15: 4-Amino-1-butanol
C-16: 3-Pyrrolidino-1,2-propanediol
C-17: 3-(dimethylamino)-1,2-propanediol
C-18: 1,4-piperazino-bis(ethanesulfonic acid)
C-19: 3-piperidino-1,2-propanediol The adding amount of the amino compound to be used in this invention is in the range of from 0.01 to 1.0 mole per liter, and preferably from 0.01 to 0.04 mole per liter.

The developer solution to be used in this invention is desirable to contain 5- or 6-nitroindazole. The compound is considerably effective in preventing a light-sensitive material from being fogged and keeping its sensitivity and contrast high. Its suitable adding amount is in the range of from 0.0001 to 0.1 mole per liter of the developer solution.

Further, the developer solution for use in the method of this invention may contain a 3-pyrazolidone compound or o- or p-aminophenol compound as a developing agent in addition to the dihydroxybenzene-type compound. The suitable pH range of the developer solution is from 10 to 12. In order to maintain the pH range, an alkali metal hydroxide or carbonate may be added as an alkali agent to the developer solution. Further, in order to restrain a light-sensitive material from being fogged due to development, an inorganic antifoggant such as potassium bromide and an organic antifoggant including a triazole compound such as 5-methylbenzotriazol, 5-chlorobenzotriazole; a mercapto compound such as 2-mercaptobenzimidazole, 1-phenyl-5-mercaptotetrazole; or the like, may be used.

The developer solution for use in the method of this invention may contain arbitrary additives according to purposes in addition to the foregoing components. Such additives include solvents, buffers, sequestering agents, development accelerators, viscosity increasing agents, emulsion layer's swelling restraining agents, and the like.

The processing in the method of this invention may take place under various conditions: developing temperature is preferably not more than 50° C. and more preferably around 40° C., and developing time is generally within three minutes; particularly, in many cases, developing within two minutes produces good results. Besides the developing process, other processes such as, e.g.. washing, stopping, stabilizing, fixing and at need additional processes such as prehardening, neutralizing, etc., may be arbitrarily employed and may also be discretionarily omitted. Furthermore, these processings may be made in manual manner such as tray development, frame development, or in mechanical way such as roller development, hanger development, or the like.

For the silver halide emulsion of the light-sensitive material to be used in this invention, various silver halides may be used, such as silver chloride, silver bromide, silver chlorobromide, silver iodobromide, silver chloroiodobromide, or the like. This invention exhibits its effect significantly when an emulsion of a silver halide composition containing not less than 50 mole % silver bromide is used, and is particularly effective to a high-speed light-sensitive material having less silver iodide (not more than 5 mole % AgI).

The silver halide suitably usable in the silver halide emulsion layer in this invention is silver chlorobromide or silver chloroiodobromide containing not less than 50 mole % silver bromide. If the silver bromide content is less than 50 mole % a fog including pepper fog tends to appear on the processed film.

The silver halide to be contained in the silver halide emulsion layer of the light-sensitive material for use in this invention is desirable to be of silver halide grains whose average grain size is from 0.1 to 1.0 μm, particularly preferably from 0.1 to 0.7 μm, and which contain grains having sizes 0.7 to 1.3 times the average grain size accounting for at least 75%, particularly preferably more than 80% of the whole silver halide grains.

The crystal habit of the silver halide grain may be either cubic or octahedral, and may also be of the tablet type as disclosed in Japanese Patent O.P.I. Publication No. 10852/1983.

The method of preparing silver halide grains of the silver halide emulsion layer in this invention may be the single-jet method according to the orderly mixing method, inversely mixing method, etc., or the double-jet method according to the simultaneously mixing method, and of these the particularly preferred is the simultaneously mixing method. Also, the preparation may be made according to the ammoniacal process, neutral process, acidic process, or the modified ammoniacal process as disclosed in Japanese Patent Examined Publication No. 3232/1983, of which the particularly preferred is the acidic process or neutral process.

These silver halide grains may contain thereinside metal atoms such as iridium, rhodium, osmium, bismuth, cobalt, nickel, ruthenium, iron, copper, zinc, lead, cadmium, etc. In the case of incorporating such metal atoms, the metal content of silver halide grains is desirable to be $10^{-8}$ to $10^{-5}$ mole per mole of the silver halide. The silver halide grain is desirable to be of the surface latent image type.

The silver halide photographic emulsion of the silver halide emulsion layer according to this invention (hereinafter referred to as the silver halide photographic emulsion of this invention) may be subjected to chemical sensitization. The chemical sensitization includes sulfur sensitization, reduction sensitization and noble-metal sensitization. In this invention, the chemical sensitization is desirable to be made by the sulfur sensitization alone. As the sulfur sensitizer, the sulfur compound contained in gelatin and various sulfur compounds such as, e.g., thiosulfates, thioureas, thiazoles, rhodanines and the like may be used; more particularly, those sulfur sensitizers as described in U.S. Pat. Nos. 1,574,944, 2,410,689, 2,728,668, and Japanese Patent Examined Publication No. 11892/2984 may be used.

The silver halide light-sensitive photographic material of this invention is desirable to further contain those compounds having the following Formulas 4, 5, 6 or 7 from the antifogging point of view.

Formula 4

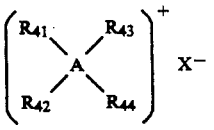

wherein A is a phosphorus atom or a nitrogen atom; $R_{41}$, $R_{42}$, $R_{43}$ and $R_{44}$ each represents a substituted or unsubstituted alkyl, aryl or aralkyl group; and $X^-$ is an acid anion.

Formula 5

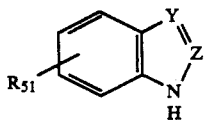

wherein Y and Z each represents a nitrogen atom or a carbon atom, provided that when either one of the Y and Z is a nitrogen atom, the other is a carbon atom; $R_{51}$ is a hydrogen atom, a lower alkyl group, a halogen atom or a nitro group.

Formula 6

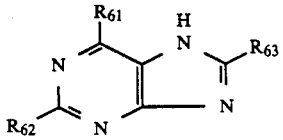

wherein $R_{61}$, $R_{62}$ and $R_{63}$ each represents a hydrogen atom, an amino group, a hydroxy group, a mercapto group, an alkyl group or an aryl group.

Formula 7

$$Y—[S\text{-}L_1\text{-}(J_1)_k\text{-}(L_2)_l\text{-}(Z)_m\text{-}(L_3)_n\text{-}(J_2L_4)_p(G)_q]_r$$

wherein $L_1$ through $L_4$ each represents a divalent hydrocarbon group; $J_1$ and $J_2$ each represents —O—, —COO—, —$CONR_{71}$—, $SO_2NR_{71}$—, —$NR_{71}$—CO—$NR_{72}$—, —$SO_2$—, —N=N—, —$NR_{71}$— or —CO—; Y represents a hydrogen atom, a divalent group or a linkage, or an amino group; Z is a heterocyclic group; G is a sulfonic group, a carboxyl group or a phosphonic acid group; $R_{71}$ and $R_{72}$ each represents a hydrogen atom, an alkyl group or an aryl group; k, l, m and n each is an integer of zero to 2; p is an integer of zero to 4; q is an integer of 1 to 4; and r is an integer of 1 or 2, provided that when G is a carboxyl group, m is an integer of 1 or 2, and when Y is a divalent group or a single linkage, r is an integer of 2.

Subsequently, the compound having Formula 4 of this invention will be explained.

In Formula 4, the alkyl group, which is allowed to have a substituent, represented by the $R_{41}$, $R_{42}$, $R_{43}$ or $R_{44}$ is preferably a lower alkyl group having from 1 to 8 carbon atoms such as methyl, ethyl, isopropyl, n-butyl or octyl group, and the substituent to the alkyl group is, for example, a hydroxy, sulfo, carboxy or amino group or a halogen atom.

The aryl group, which may have a substituent, represented by the $R_{41}$, $R_{42}$, $R_{43}$ or $R_{44}$ is a phenyl or naphthyl group, and preferably the phenyl group. The substituent to the aryl group is an alkyl group, preferably a lower alkyl group having 1 to 8 carbon atoms; an alkoxycarbonyl group an alkylsulfonyl group, an alkylcarbonyl group, the alkyl portion of which groups has 1 to 8 carbon atoms; a nitro group, a cyano group, a halogen atom, a —$N(C_2H_5)_2HCl$— group, or the like.

The aralkyl group, which may have a substituent, represented by the $R_{41}$, $R_{42}$, $R_{43}$ or $R_{44}$ is, for example, a benzoyl, phenyl or the like group, and preferably the benzoyl group. The substituent to the aralkyl group includes, for example, the same groups as those to the above aryl group.

The substituent to the electron attractive group owned by the aryl or aralkyl group represented by the $R_{41}$, $R_{42}$, $R_{43}$ or $R_{44}$ is typified by a halogen atom or a nitro, cyano, carbonyl, carboxyl, sulfonyl or quaternary amino group.

The anion represented by the $X^-$ is a chloride ion, bromide ion, iodide ion, cyanide ion, hypochlorite ion, p-toluene-sulfonate ion, benzene-sulfonate ion, hydroxide ion, or the like.

The compound having Formula 4 may be easily synthesized in accordance with the method described in Japanese Patent Examined Publication No. 40665/1975.

As will be shown in the example given hereinafter, where a compound which is similar in the chemical structure to the foregoing Formula 4 but comprises an aryl or aralkyl group having no electron attractive substituent is used, the compound has no pepper fog restraining effect to the resulting light-sensitive photographic material.

The following are examples of the compound having Formula 4, but this invention is not limited by the examples.

4-1

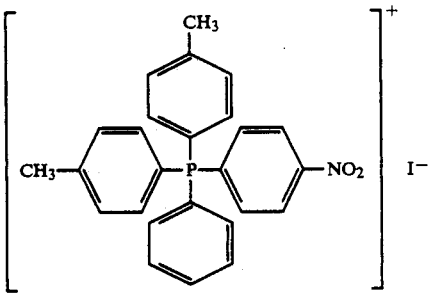

4-2

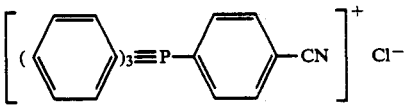

4-3

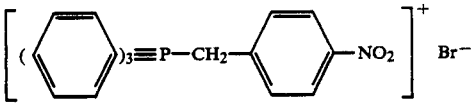

4-4

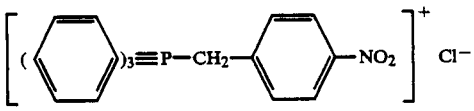

4-5

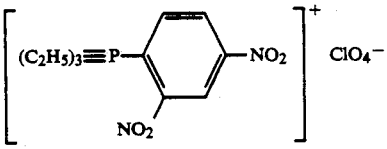

4-6

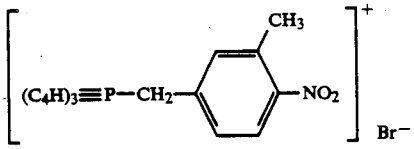

4-7

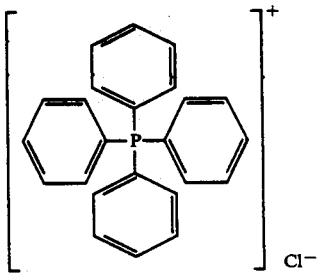

4-8

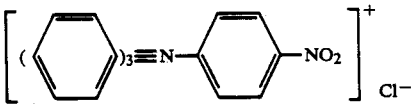

-continued 4-9

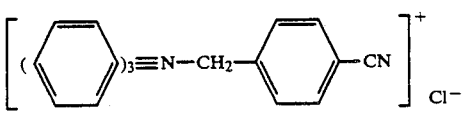

4-10

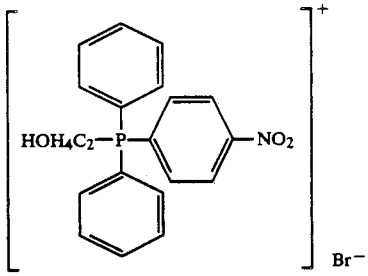

4-11

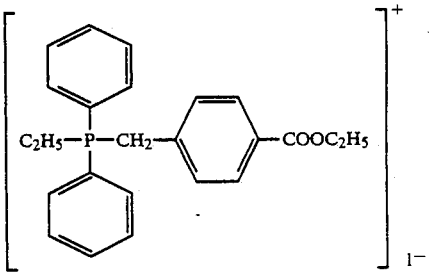

4-12

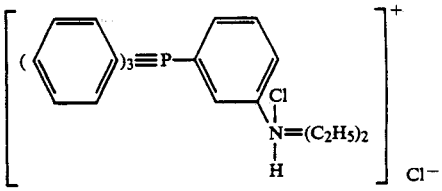

4-13

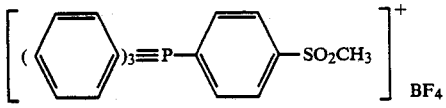

4-14

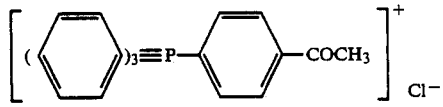

4-15

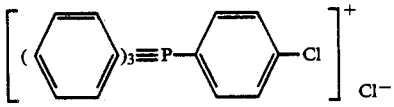

4-16

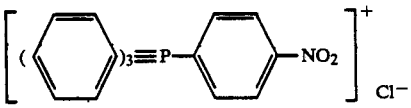

4-17

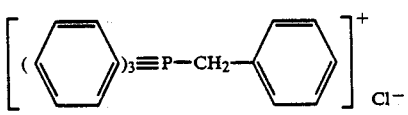

Incorporation of the compound having Formula 4 into the component of a silver halide light-sensitive photographic material should be made in the manner that the compound is dissolved in water or in an organic solvent arbitrarily miscible with water, such as methanol or ethanol, and the solution is then incorporated into the component. The adding amount of the compound, although it depends on the types of the silver halide, component, compound, etc. to be used, is generally from $10^{-7}$ to $10^{-3}$ mole per mole of silver halide, and more preferably from $10^{-6}$ to $10^{-4}$ mole.

Next, the compound having the foregoing Formula 5 will be explained.

In Formula 5, the lower alkyl group represented by the $R_{51}$ may be a straight-chain or branched-chain alkyl group having 1 to 8 carbon atoms, such as methyl, ethyl, isopropyl or butyl group.

Typical examples of the compound having Formula 5 are given below:

5-1: 5-Nitroindazole
5-2: 6-Nitroindazole
5-3: 5-Methyl-indazole
5-4: 6-Methyl-indazole
5-5: Indazole
5-6: 5-Chlorobenzimidazole
5-7: 5-Methyl-benzimidazole
5-8: 5-Ethyl-benzimidazole
5-9: 5-Nitrobenzimidazole
5-10: 6-Nitrobenzimidazole
5-11: 5-Chlorobenzimidazole
5-12: Benzimidazole Any of these compounds having Formula 5 may be used in the adding amount range of from $1\times10^{-5}$ to $1\times10^{-1}$ mole per mole of silver halide, and more preferably from $1\times10^{-4}$ to $1\times10^{-2}$ mole. Incorporation of the compound may be performed in accordance with that of the compound having Formula 1.

The compound having Formula 6 will then be explained.

In Formula 6, the alkyl group represented by the $R_{61}$, $R_{62}$ or $R_{63}$, may be either straight-chain or branched-chain, preferably having from 1 to 16 carbon atoms, such as methyl, ethyl or a long-chain alkyl group like dodecyl group. The aryl group represented by the $R_{61}$, $R_{62}$ or $R_{63}$ is a phenyl or naphthyl group.

The following are typical examples of the compound having Formula 6:

6-1: 6-Aminopurine
6-2: 4-Amino-6-hydroxypurine
6-3: 6-Benzylaminopurine
6-4: 6-Mercaptopurine
6-5: 4,6-Dihydroxypurine
6-6: 4,6-Diaminopurine
6-7: 1-Methyl-6-aminopurine
6-8: 4-Methyl-6-aminopurine
6-9: 1-hydroxy-6-aminopurine
6-10: 1-Mercapto-4-octyl-purine
6-11: 4-Phenyl-6-aminopurine
6-12: 1,6-Diaminopurine Any of these compounds having Formula 6 is used in the adding amount range of from $1\times10^{-5}$ to $1\times10^{-1}$ mole per mole of silver halide, and more preferably from $1\times10^{-4}$ to $1\times10^{-1}$ mole. Incorporation of the compound may be performed in accordance with that of Formula 1.

The compound having Formula 7 will now be explained.

In Formula 7, the divalent hydrocarbon group represented by the $L_1$ to $L_4$ is, for example, an alkylene, arylene or aralkylene group. The alkylene group is preferably a straight-chain or cyclic one having from 1 to 15 carbon atoms, such as, e.g., a methylene, ethylene, propylene, pentamethylene, dodecamethylene, methylene, 1,6-cyclohexylene or the like group.

The arylene group represented by the $L_1$ or $L_2$ is, for example, a 1,4-phenylene, 1,3-phenylene, 1,4-naphthylene, 1,4-anthraquinolylene or the like group. And the aralkylene group is, for example, a benzylene, phenethylene or the like group.

The amidino group represented by the Y includes one having a substituent. The substituent is, for example, an alkyl group such as methyl, ethyl, benzyl, etc., an aryl group such as a phenyl, p-tolyl, naphthyl, etc., or a heterocyclic group such as 2-thiazolyl, 2-pyridyl, 4-imidazolyl, etc.

The heterocyclic group represented by the Z is preferably a 5- to 7-member cyclic group, which includes those condensed with a benzene ring, naphthalene ring, 5- or 6-member heterocyclic ring or 5- or 6-member aliphatic ring: e.g., such heterocyclic rings as furan, thiophene, benzo[b]thiophene, imidazole, benzimidazole, pyrrole, s-triazine, pyrimidine, quinoline, indole, benzoxazole, benzothiazole, and the like.

The alkyl group represented by the $R_{71}$ or $R_{72}$ is, e.g., a methyl, ethyl, propyl or the like group, and the aryl group is, e.g., a phenyl or naphthyl group.

Further, the divalent hydrocarbon group represented by the $L_1$ to $L_4$, the alkyl and aryl groups each represented by the $R_{71}$ or $R_{72}$, and the heterocyclic group represented by the Z include those each having a substituent. Examples of the substituent include, e.g., alkyl groups such as methyl, ethyl, sec-propyl, etc.; alkoxy groups such as methoxy, ethoxy, etc.; amino groups such as methylamino, N,N-dimethylamino, butylamino, etc ; aryl groups such as tolyl, phenyl, etc.; aryloxy groups such as phenoxy, naphthoxy, etc.: mercapto group, sulfo group, carboxy group, cyano group, carbamoyl group, sulfamoyl group; amido groups such as acetylamino, benzoylamino, etc.; sulfonyl groups such as methanesulfonyl, benzenesulfonyl, etc.; alkoxycarbonyl groups such as ethoxycarbonyl: aryloxycarbonyl groups such as phenyloxycarbonyl; acyl groups such as acetyl, benzoyl, propionyl, etc.; heterocyclic groups such as thienyl, oxazolyl, cinnolyl, etc.; and in addition, $-J_2L_4G$ and $-J_1-L_1-SH$, wherein $J_2$, $J_2$, $L_1$, $L_4$ and G are as defined previously.

The carboxyl group, sulfo group and phosphoric acid group represented by the G may either be free-acid or form their corresponding salts, and those to form their corresponding salts include inorganic cations including alkali metals such as Na, K, Li; alkaline earth metals such as Ca. Mg; and ammonium; or organic ammoniums such as pyridinium, triethyl ammonium, triethanol ammonium, guanidium, and the like; and further, they may form intramolecular salts.

The compound having Formula 7, which is applicable to this invention, according to selection of the Y, is classified as mercapto-substituted anionic derivatives (7-I), pseudothiuronium intramolecular salt derivatives (7-II) and disulfide derivatives (7-III). The following are typical examples of these compounds:

7-I-1
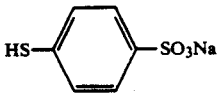
7-I-2
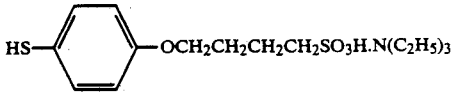
7-I-3
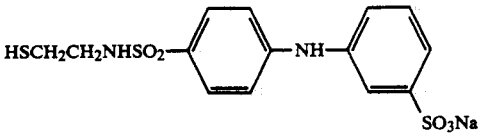
7-I-4
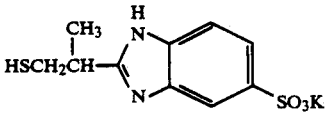
7-I-5
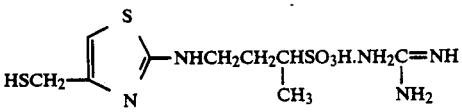
7-I-6
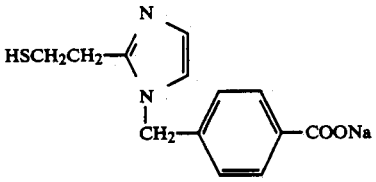
7-I-7
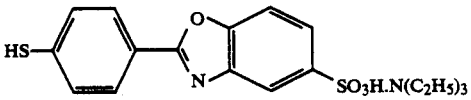
7-I-8
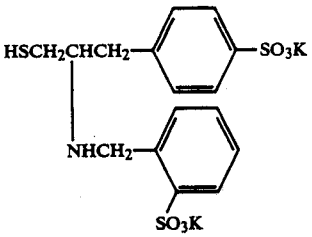
7-I-9
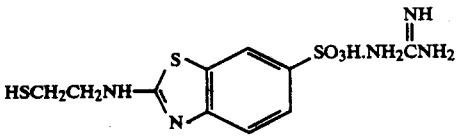
7-I-10
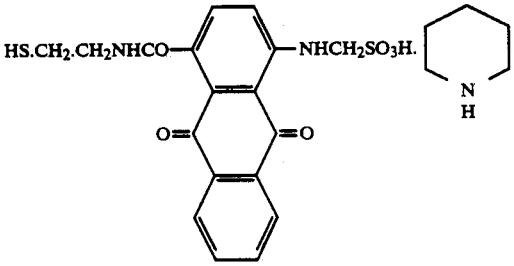

-continued
$HSCH_2CH_2CH_2SO_3H.H_2NC(=NH)NH_2$ 7-I-11
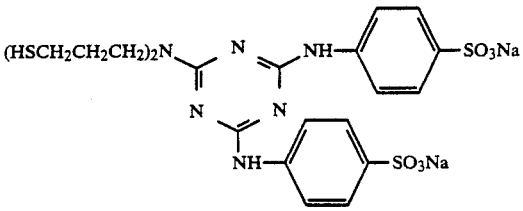
7-I-12
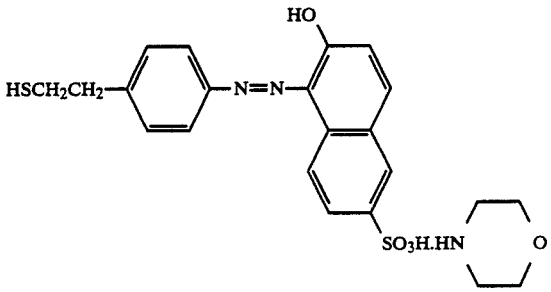
7-I-13
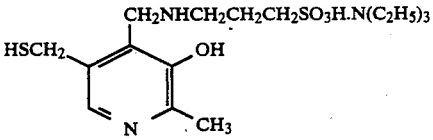
7-I-14
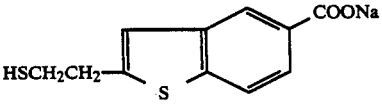
7-I-15
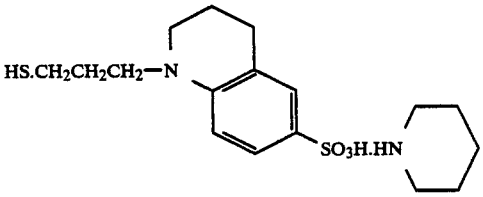
7-I-16
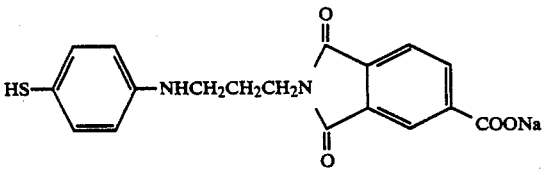
7-I-17
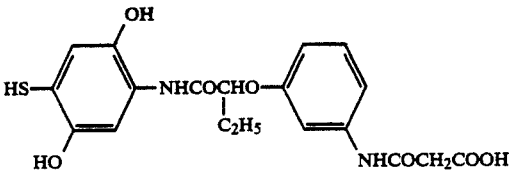
7-I-18
$HSCH_2CH_2OCH_2CH_2OCH_2CH_2OCH_2CH_2SO_3H.N(C_2H_5)_3$ 7-I-19
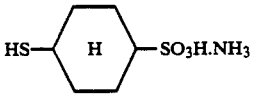
7-I-20

-continued
7-I-21
$HS(CH_2)_6SO_3H.NH_2C(=NH)-NH_2$
7-I-22
$HS(CH_3)CH-CH_2CH_2CH_2CH_2CH_2SO_3H.N(C_2H_5)_3$
7-I-23
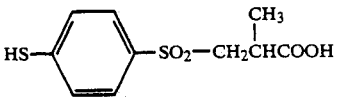
7-I-24
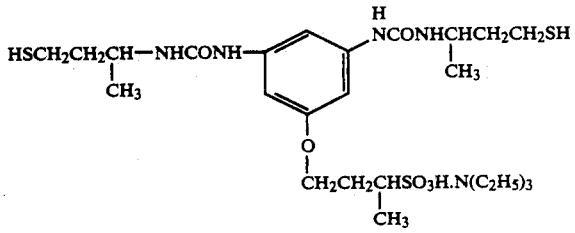
7-I-25
$HS.(CH_2)_2SO_3H$
7-I-26
$HS-CH_2CH_2CH(CH_3)-SO_3Na$
7-I-27
$HS(CH_2)_4SO_3K$
7-I-28
$NaS(CH_2)_5SO_3Na$
7-I-29
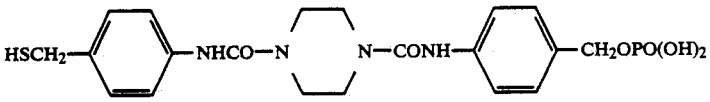
7-I-30
$HSCH_2CH_2CO(CH_2)_3OPO(OH)_2$
7-II-1
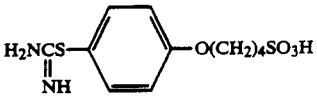
7-II-2
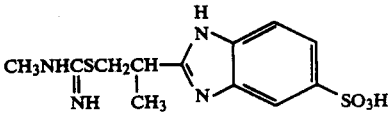
7-II-3
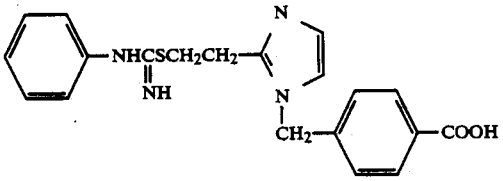
7-II-4
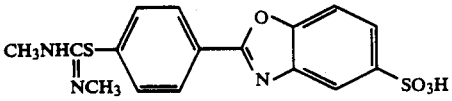
7-II-5
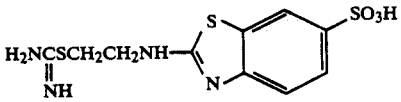

-continued
7-II-6
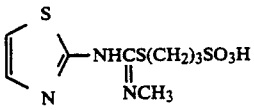
7-II-7
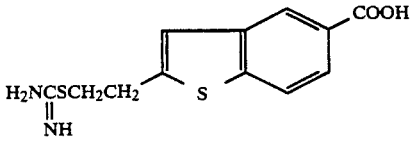
7-II-8
$H_2NCS(CH_2CH_2O)_3CH_2CH_2SO_3H$
‖
NH
7-II-9
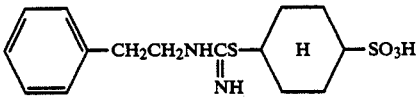
7-II-10
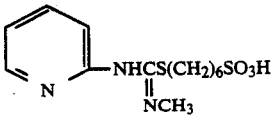
7-II-11
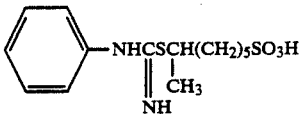
7-II-12
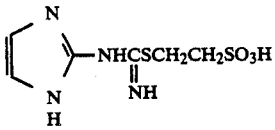
7-II-13
$CH_2{=}CHCH_2NHCS(CH_2)_4SO_3H$
‖
NH
7-II-14
$H_2NCS(CH_2)_3SO_3H$
‖
NH
7-II-15
$H_2NCSCH_2CH_2SO_3H$
‖
NH
7-II-16
$H_2NCSCH_2CH_2CHSO_3H$
‖ |
NH $CH_3$
7-II-17
$H_2NCS(CH_2)_4SO_3H$
‖
NH
7-II-18
$H_2NCS(CH_2)_5SO_3H$
‖
NH
7-III-1
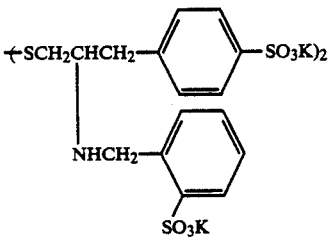

-continued

7-III-2

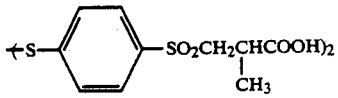

7-III-3

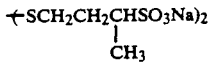

These Compounds having Formula 7 may be easily synthesized by making reference to literatures such as, e.g., J. Am. Chem. Soc., 77, 6231(1955); J. Heterocycl. Chem., 1968, 5(3) 319–22; Arm. Khim. Zh., 1976, 20(10), 832–5; and the like.

That is, in general, the pseudothiuronium intramolecular salt derivative (7-II) can be obtained by effecting addition reaction in a water-soluble solvent such as, e.g., methanol, ethanol, water-containing ethanol, etc., in accordance with the following scheme:

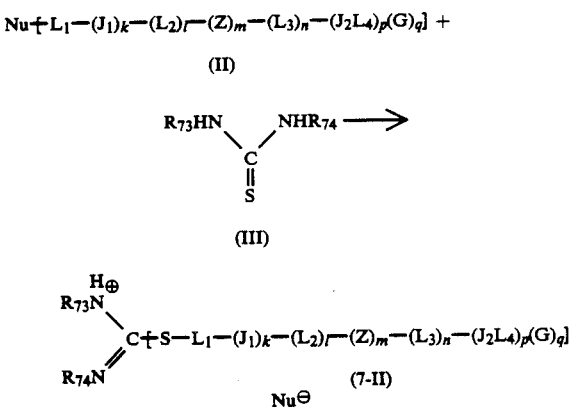

The sulfide derivative (7-I), part of the compound of this invention, is synthesized by hydrolyzing in a moderate alkaline atmosphere the compound (7-II) shown in the above scheme; to be concrete, can be isolated as a guanidium salt by heating the compound (7-II) in an aqueous ammonium solution The guanidium salt may be converted into an arbitrary salt by being subjected to ion exchange treatment or salt exchange operation.

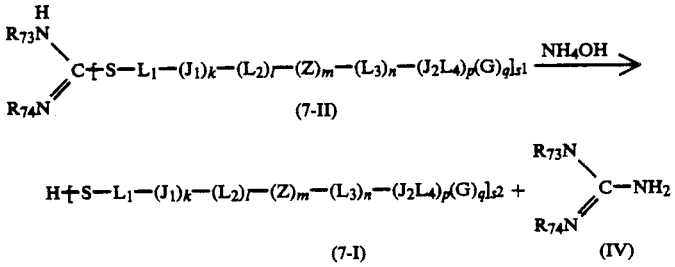

The sulfide derivative (7-I), by being oxidized, is made into a disulfide derivative (7-III).

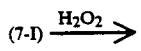

-continued

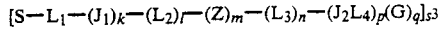

(7-III)

In Formulas II. 7-I, 7-II and 7-III, the $L_1$ to $L_4$, $J_1$ and $J_2$, Z, G, k, l, m, n, p, q and r are all as defined in the foregoing Formula 7; the $s^1$ and $s^2$ each is an integer of 1; and $s^3$ is an integer of 2 .

In Formula II, the Nu represents a nucleophilic group such as, e.g., a chlorine atom, bromine atom, iodine atom, p-toluenesulfonyloxy group, trifluoromethyl-sulfonyloxy group, or the like.

In Formula III, the $R_{73}$ and $R_{74}$ each represents a hydrogen atom or an alkyl, aryl or heterocyclic group.

Any of these compounds having Formula 7 may be incorporated either into a light-sensitive material or into a developer solution. In the case of the incorporation into a light sensitive material, the compound is allowed into all the photographic layers including silver halide emulsion layers, and its adding amount is preferably from $1\times10^{-7}$ to $1\times10^{-3}$ mole per $m^2$. When the compound is to be added to a developer solution, its suitable adding amount is from $1\times10^{-1}$ to $1\times10^{-3}$ mole per liter. The incorporation of the compound is carried out generally in the manner that it is dissolved into water or an organic solvent arbitrarily miscible with water, such as methanol, ethanol, etc., and the solution is then added.

The silver halide emulsion which is applicable to this invention may be made color-sensitive to desired wavelength regions by using sensitizing dyes. Usable sensitizing dyes include those commonly available ones including methine dyes and styryl dyes, such as cyanines, hemicyanines, rhodacyanines, merocyanines, oxonols, hemioxonols and the like.

Reference can be made for the above-mentioned dyes to U.S. Pat. Nos. 2,742,833, 2,756,148, 3,567,458, 3,615,517, 3,615,519, 3,632,340, 3,155,519, 3,384,485, 4,232,115, 3,796,580, 4,028,110, 3,752,673, Japanese Patent O.P.I. Publication No. 45015/1980 and the like.

Particularly preferred among these sensitizing dyes are those compounds having the following Formulas 8 through 11:

Formula 8

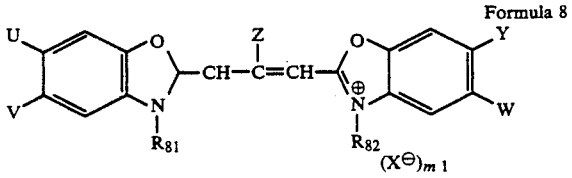

wherein $R_{81}$ and $R_{82}$ each represents a substitutable alkyl group, provided that at least one of the $R_{81}$ and $R_{82}$ is a sulfoalkyl or carboxyalkyl group; Z is an alkyl or aralkyl group; U, V, W and Y each is a hydrogen atom, halogen atom or substitutable alkyl group, substitutable alkoxy group, substitutable alkoxycarbonyl group, carboxyl group or hydroxyl group: $X^-$ is an acid anion; and m is an integer of 1 or 2, provided that the m is 1 when an intramolecular salt is formed.

Examples of the substituent to the alkyl group represented by the $R_{81}$ or $R_{82}$ include hydroxyl group, sulfo group, sulfonate group, carboxyl group and salts thereof; halogen atoms such as fluorine atom, chlorine atom, etc.; substituted or unsubstituted alkoxy groups having from 1 to 4 carbon atoms, which may be further substituted by a sulfo group, hydroxyl group, etc.; alkoxycarbonyl groups having from 2 to 5 carbon atoms; alkylsulfonyl groups having from 1 to 4 carbon atoms; sulfamoyl group; substituted or unsubstituted carbamoyl groups including carbamoyl groups substituted by an alkyl group having from 1 to 4 carbon atoms; phenyl groups substituted by, e.g., a sulfo group, carboxyl group, hydroxyl group, etc.; vinyl group; and the like.

Examples of the unsubstituted alkyl group include methyl, ethyl, propyl and butyl groups. Examples of the substituted alkyl group include hydroxyalkyl groups such as 2-hydroxyethyl, 3-hydroxypropyl, etc.; sulfoalkyl groups such as 2-sulfoethyl, 3-sulfopropyl, 3-sulfobutyl, 4-sulfobutyl, 2-hydroxy-3-sulfopropyl, 2-chloro-3-sulfopropyl, etc.; carboxyalkyl groups such as carboxymethyl, carboxyethyl, carboxypropyl, etc.; 2,2,2-trifluoroethyl group: 2-(3-sulfopropyloxy)ethyl group; 2-(2-hydroxyethoxy)ethyl group; ethoxycarbonylethyl group; methylsulfonylethyl group; sulfamoylalkyl groups such as 2-sulfamoylethyl group; 2-carbamoylethyl group; 2-N,N-dimethyl-carbamoylethyl group; phenethyl group: p-carboxyphenethyl group; sulfoaralkyl groups such as p-sulfophenethyl, etc.; p-hydroxyphenethyl group; phenoxyethyl group: and the like.

The halogen atom represented by the U, V, W or Y is, e.g., a fluorine atom, chlorine atom, bromine atom, or the like. The alkyl group is, e.g., a methyl, ethyl, propyl, butyl or the like group. The alkoxy group is, e.g., a methoxy, ethoxy, propoxy, butoxy or the like group. The alkoxycarbonyl group is, e.g., a methoxycarbonyl, ethoxycarbonyl or the like group. Each of these groups may be substituted by a halogen atom, sulfo group, hydroxyl group, carboxy group, or the like.

The alkyl group represented by the Z is, for example, a methyl, ethyl or propyl group. The aralkyl group represented by the Z is, e.g., a benzyl group. The acid anion represented by the $X^-$ is, for example, a chloride, bromide, iodide, thiocyanate, sulfonate, methyl sulfonate, ethyl sulfonate, perchlorate, p-toluene-sulfonate, or the like.

Examples of the compound having Formula which is applicable to this invention, will be given in Table 1.

TABLE 1

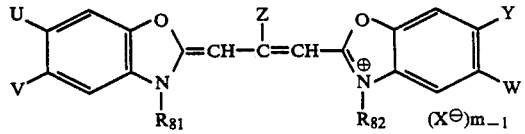

| No. | V | W | U | Y | $R_{81}$ | $R_{82}$ | Z |
|---|---|---|---|---|---|---|---|
| 8-1 | Cl | Cl | H | H | $(CH_2)_3SO_3Na$ | $(CH_2)_3SO_3^{\ominus}$ | $C_2H_5$ |
| 8-2 | Cl | Cl | H | H | $(CH_2)_4SO_3Na$ | $(CH_2)_3SO_3^{\ominus}$ | $C_2H_5$ |
| 8-3 | Cl | Cl | $CH_3$ | H | $(CH_2)_3SO_3Na$ | $(CH_2)_3SO_3^{\ominus}$ | $C_2H_5$ |
| 8-4 | Cl | Cl | $CH_3$ | $CH_3$ | $(CH_2)_3SO_3Na$ | $(CH_2)_3SO_3^{\ominus}$ | $C_2H_5$ |
| 8-5 | Cl | 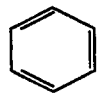 | H | H | $(CH_2)_3SO_3Na$ | $(CH_2)_3SO_3^{\ominus}$ | $C_2H_5$ |
| 8-6 | Cl | 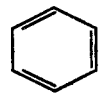 | $CH_3$ | H | $(CH_2)_3SO_3Na$ | $(CH_2)_3SO_3^{\ominus}$ | $C_2H_5$ |
| 8-7 | Cl | 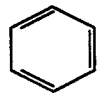 | $CH_3$ | $CH_3$ | $(CH_2)_3SO_3Na$ | $(CH_2)_4SO_3^{\ominus}$ | $C_2H_5$ |
| 8-8 | $CH_3$ | 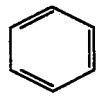 | $CH_3$ | $CH_3$ | $(CH_2)_3SO_3Na$ | $(CH_2)_3SO_3^{\ominus}$ | $C_2H_5$ |
| 8-9 | $OCH_3$ | $OCH_3$ | H | H | $(CH_2)_3SO_3Na$ | $(CH_2)_3SO_3^{\ominus}$ | $C_2H_5$ |
| 8-10 | $OCH_3$ | $OCH_3$ | H | H | $(CH_2)_3SO_3Na$ | $CH_2COO^{\ominus}$ | $CH_3$ |

TABLE 1-continued

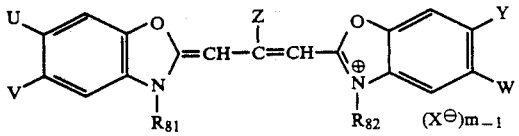

| No. | V | W | U | Y | $R_{81}$ | $R_{82}$ | Z |
|---|---|---|---|---|---|---|---|
| 8-11 | | | H | H | $(CH_2)_3SO_3Na$ | $(CH_2)_3SO_3^{\ominus}$ | $C_2H_5$ |
| 8-12 | $CF_3$ | $CF_3$ | H | H | $(CH_2)_3SO_3Na$ | $(CH_2)_3SO_3^{\ominus}$ | $C_2H_5$ |
| 8-13 | $CF_3$ | | H | H | $(CH_2)_4SO_3Na$ | $(CH_2)_3SO_3^{\ominus}$ | $C_2H_5$ |
| 8-14 | | $OCH_3$ | H | H | $(CH_2)_4SO_3Na$ | $(CH_2)_3SO_3^{\ominus}$ | $CH_3$ |
| 8-15 | $OCH_3$ | $COCH_3$ | H | H | $(CH_2)_3SO_3Na$ | $(CH_2)_3SO_3^{\ominus}$ | $C_2H_5$ |
| 8-16 | $OCH_3$ | | H | H | $(CH_2)_3SO_3Na$ | $(CH_2)_3SO_3^{\ominus}$ | $C_2H_5$ |

Formula 9

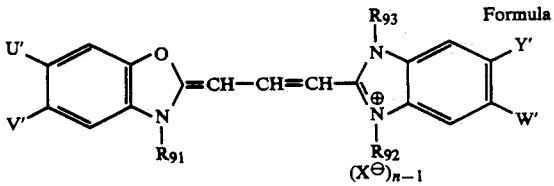

wherein $R_{91}$, $R_{92}$ and $R_{93}$ each represents a substitutable alkyl group; U', V', W' and Y' each represent a hydrogen atom, halogen atom, trifluoromethyl group, cyano group, carboxyl group, alkoxy group, alkoxycarbonyl group, hydroxyl group, acyloxy group, hydroxyalkyl group, hydroxyalkoxy group or phenyl group; $X^-$ is an acid anion; and n is an integer of 1 of 2, provided that the n is 1 when an intramolecular salt is formed.

The alkyl group represented by the $R_{91}$, $R_{92}$ or $R_{93}$ is as defined in the alkyl group of the $R_{81}$ or $R_{82}$ of Formula 8.

The alkoxy group represented by the U', V', W' or Y' is, for example, a methoxy group, ethoxy group, propoxy group or butoxy group; the alkoxycarbonyl group is, for example, a methoxycarbonyl group, ethoxycarbonyl group, or the like; the acyloxy group is, for example, an acetyloxy group, propionyloxy group or the like; the hydroxyalkyl group is, e.g., a hydroxymethyl group, hydroxyethyl group, hydroxypropyl group, hydroxybutyl group of the like; and the hydroxyalkoxy group is, e.g., a hydroxymethoxy group, hydroxyethoxy group, hydroxypropoxy group, hydroxybutoxy group or the like.

The acid anion represented by the $X^-$ is as defined in the $X^-$ of Formula 8.

Examples of the compound having Formula 9, applicable to this invention, will be given in the following Table 2.

TABLE 2

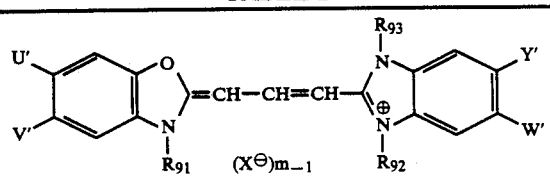

| No. | V' | W' | U' | Y' | $R_{91}$ | $R_{92}$ | $R_{93}$ | $X^{\ominus}$ |
|---|---|---|---|---|---|---|---|---|
| 9-1 | H | Cl | H | $C_2H_5$ | $C_2H_5$ | $C_2H_5$ | $C_2H_5$ | $I^{\ominus}$ |
| 9-2 | H | Cl | Cl | Cl | $CH_3$ | $CH_3$ | $C_2H_5$ | $I^{\ominus}$ |
| 9-3 | H | Cl | H | Cl | $CH_3$ | $(CH_2)_3SO_3^{\ominus}$ | $C_2H_5$ | |
| 9-4 | OH | Cl | H | Cl | $C_2H_5$ | $(CH_2)_4SO_3^{\ominus}$ | $C_2H_5$ | |
| 9-5 | H | Cl | H | Cl | $C_2H_5$ | $(CH_2)_4SO_3^{\ominus}$ | $(CH_2)_3OH$ | |
| 9-6 | H | Cl | H | Cl | $C_2H_5$ | $(CH_2)_3SO_3^{\ominus}$ | $CH_2CH_2OCH_2CH_2OH$ | |

TABLE 2-continued

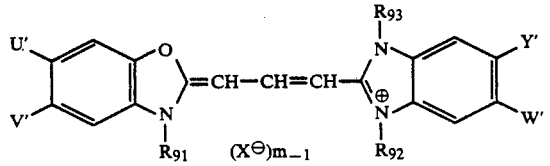

| No. | V' | W' | U' | Y' | $R_{91}$ | $R_{92}$ | $R_{93}$ | $X^{\ominus}$ |
|---|---|---|---|---|---|---|---|---|
| 9-7 | Cl | Cl | H | Cl | $C_2H_5$ | $(CH_2)_3SO_3^{\ominus}$ | $CH_2-CH(OH)-CH_3$ | |
| 9-8 | $CF_3$ | Cl | H | Cl | $C_2H_5$ | $(CH_2)_3SO_3^{\ominus}$ | $C_2H_4OH$ | |
| 9-9 | H | CN | H | H | $(CH_2)_3SO_3Na$ | $(CH_2)_3SO_3^{\ominus}$ | $C_2H_5$ | |
| 9-10 | $OCH_3$ | CN | H | H | $(CH_2)_2SO_3Na$ | $(CH_2)_2SO_3^{\ominus}$ | $C_2H_5$ | |
| 9-11 | $COOCH_3$ | CN | H | H | $C_2H_5$ | $(CH_2)_3SO_3^{\ominus}$ | $C_2H_5$ | |
| 9-12 | H | $CF_3$ | H | H | $C_2H_5$ | $(CH_2)_3SO_3^{\ominus}$ | $C_2H_5$ | |
| 9-13 | H | Cl | H | $CH_3$ | $(CH_2)_2SO_3Na$ | $(CH_2)_2COO^{\ominus}$ | $C_2H_5$ | |
| 9-14 | 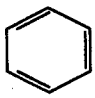 | Cl | H | H | $(CH_2)_3SO_3^{\ominus}$ | $C_2H_5$ | $C_2H_5$ | |
| 9-15 | 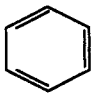 | Cl | H | H | $C_2H_5$ | $C_2H_5$ | $C_2H_5$ | $I^{\ominus}$ |
| 9-16 | 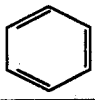 | $CF_3$ | H | H | $C_2H_5$ | $C_2H_5$ | $C_2H_5$ | $I^{\ominus}$ |

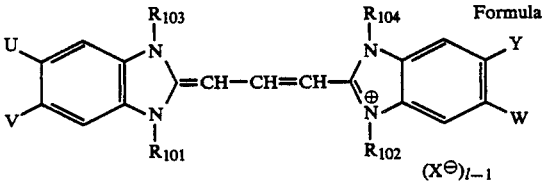

Formula 10 wherein $R_{101}$, $R_{102}$, $R_{103}$ and $R_{104}$ each represents a substitutable alkyl group; U, V, W and Y each represents a hydrogen atom, halogen atom, substitutable alkyl group, substitutable alkoxy group, substitutable alkoxycarbonyl group, carboxyl group, hydroxyl group, cyano group or substitutable acyloxy group.

The alkyl group represented by the $R_{101}$, $R_{102}$, $R_{103}$ or $R_{104}$ is as defined in that of the $R_{81}$ or $R_{82}$ of Formula 8; the halogen atom, alkyl group, alkoxy group and alkoxycarbonyl group represented by the U, V, W or Y are as defined in the U or Y of Formula 8; the acyloxy group is as defined in the U or Y of Formula 9; and 1 is an integer of 1 or 2.

The acid anion represented by the $X^-$ is as defined in the $X^-$ of Formula 8.

Examples of the compound of Formula 10 will be given in the following Table 3.

TABLE 3

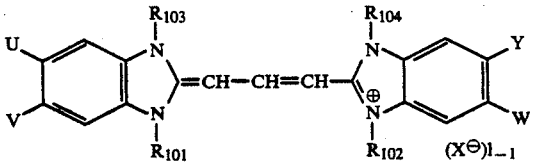

| No. | V | W | U | Y | $R_{101}$ | $R_{102}$ | $R_{103}$ | $R_{104}$ | $X^{\ominus}$ |
|---|---|---|---|---|---|---|---|---|---|
| 10-1 | $COOC_2H$ | $COOC_2H_5$ | H | H | $C_2H_5$ | $C_2H_5$ | $C_2H_5$ | $C_2H_5$ | $I^-$ |
| 10-2 | $CF_3$ | $CF_3$ | H | H | $C_2H_5$ | $C_2H_5$ | $C_2H_5$ | $C_2H_5$ | $I^-$ |
| 10-3 | F | F | H | H | $C_2H_5$ | $C_2H_5$ | $C_2H_5$ | $C_2H_5$ | $I^-$ |
| 10-4 | $CF_3$ | $CF_3$ | Cl | Cl | $C_2H_5$ | $C_2H_5$ | $C_2H_5$ | $C_2H_5$ | $I^-$ |
| 10-5 | $SO_2N(CH_3)_2$ | $SO_2N(CH_3)_2$ | H | H | $C_2H_5$ | $C_2H_5$ | $C_2H_5$ | $C_2H_5$ | $I^-$ |
| 10-6 | Cl | Cl | H | H | $C_2H_5$ | $C_2H_5$ | $C_2H_5$ | $C_2H_5$ | $I^-$ |
| 10-7 | $CONH_2$ | $CONH_2$ | H | H | $C_2H_5$ | $C_2H_5$ | $C_2H_5$ | $C_2H_5$ | $I^-$ |
| 10-8 | Cl | Cl | Cl | Cl | $(CH_2)_3SO_3Na$ | $(CH_2)_3SO_3^{\ominus}$ | $C_2H_5$ | $C_2H_5$ | |
| 10-9 | $COOC_2H_5$ | $COOC_2H_5$ | H | H | $(CH_2)_3SO_3Na$ | $(CH_2)_3SO_3^{\ominus}$ | $C_2H_5$ | $C_2H_5$ | |
| 10-10 | CN | CN | H | H | $(CH_2)_3SO_3Na$ | $(CH_2)_3SO_3^{\ominus}$ | $C_2H_5$ | $C_2H_5$ | |
| 10-11 | $SO_2N(CH_3)_2$ | $SO_2N(CH_3)_2$ | H | H | $(CH_2)_3SO_3Na$ | $(CH_2)_3SO_3^{\ominus}$ | $C_2H_5$ | $C_2H_5$ | |
| 10-12 | $COOC_2H_5$ | $COOC_2H_5$ | Cl | Cl | $(CH_2)_4SO_3Na$ | $(CH_2)_4SO_3^{\ominus}$ | $C_2H_5$ | $C_2H_5$ | |

TABLE 3-continued

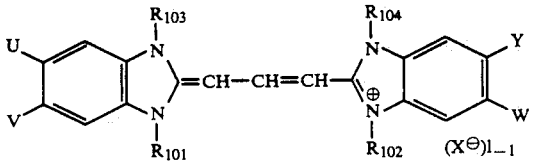

| No. | V | W | U | Y | $R_{101}$ | $R_{102}$ | $R_{103}$ | $R_{104}$ | $X^{\ominus}$ |
|---|---|---|---|---|---|---|---|---|---|
| 10-13 | CN | CN | Cl | Cl | $(CH_2)_3SO_3Na$ | $(CH_2)_3SO_3^{\ominus}$ | $C_2H_5$ | $C_2H_5$ | |
| 10-14 | $CO_2CH_3$ | $CO_2CH_3$ | H | H | $(CH_2)_3SO_3Na$ | $(CH_2)_3SO_3^{\ominus}$ | $CH_2CH_2CN$ | $CH_2CH_2CN$ | |
| 10-15 | Cl | Cl | Cl | Cl | $(CH_2)_2CO_2C_2H_5$ | $C_2H_5$ | $CH_3$ | $CH_3$ | $I^-$ |
| 10-16 | $CH_3O$ | $CH_3O$ | H | H | $C_2H_5$ | $C_2H_5$ | $C_2H_5$ | $C_2H_5$ | $I^-$ |

These sensitizing dyes having Formulas 8 through 10 are of the prior art, and may be easily synthesized by those methods of the prior art; for example, in accordance with those methods as described in the literature cited in, e.g., F. M. Homes, 'The Cyanine Dyes and Related Compounds,' Interscience Publishers, New York (1964).

Formula 11

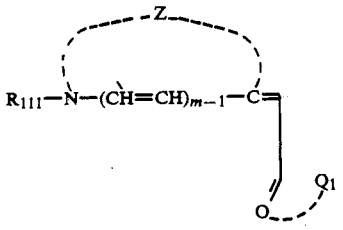

In the above formula, $R_{111}$ is an alkyl group, particularly an alkyl group having from 1 to 8 carbon atoms, which is preferably a methyl, ethyl, 2-hydroxyethyl, 2-methoxyethyl, 2-acetoxyethyl, carboxymethyl, 2-carboxyethyl, 3-carboxypropyl, 4-carboxybutyl, sulfoethyl, 3-sulfopropyl, 3-sulfobutyl, 4-sulfobutyl, vinylmethyl, benzyl, phenethyl, n-propyl, isopropyl, n-butyl or the like group. Z is a group of non-metal atoms necessary to form a 5- or 6-member heterocyclic ring, such as, e.g., a thiazole ring, selenazole ring, oxazole ring, benzothiazole ring, benzoselenazole ring, benzoxazole ring, naphthothiazole ring, naphthoselenazole ring, naphthoxazole ring, pyridine ring, quinoline ring, or the like. Each heterocyclic ring may have a substituent such as, e.g., a halogen atom such as chlorine, bromine, etc.; and alkyl group, preferably an alkyl group having from 1 to 4 carbon atoms, such as methyl, ethyl, n-propyl, etc.; a halogenated alkyl group such as trifluoromethyl; an alkoxy group, preferably an alkoxy group having from 1 to 4 carbon atoms, such as methoxy, ethoxy, n-propyloxy, etc.; a hydroxy group; an aryl group such as phenyl; or the like. $Q_1$ is a group of nonmetal atoms necessary to form a 5-member cyclic ring such as a rhodanine ring, thiohydantoin ring, thiooxazolidine-di-one ring, thioselenalidine-di-one ring or the like. Each of these heterocyclic rings may have a substituent such as an alkyl group, preferably an alkyl group having from 1 to 8 carbon atoms, such as methyl, ethyl, n-propyl, 2-hydroxyethyl, 2-hydroxyethyloxyethyl, 2-methoxyethyl, 2-acetoxyethyl, carboxymethyl, 2-carboxyethyl, 3-carboxypropyl, 4-carboxybutyl, 2-sulfoethyl, 3-sulfopropyl, 3-sulfobutyl, 4-sulfobutyl, benzyl, phenethyl, n-propyl, n-butyl, etc.; an aryl group such as phenyl, p-sulfophenyl, etc.; pyridyl group such as 2-pyridyl, 3-pyridyl, 4-pyridyl, 4-methyl-2-pyridyl, etc.; or the like. And m is an integer of 1 or 2.

Examples of the compound having Formula 11 include, for example, the following Compounds 11-1 through 11-25:

11-1

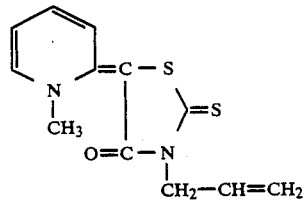

11-2

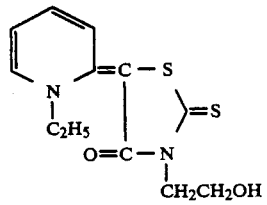

11-3

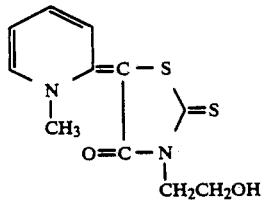

11-4

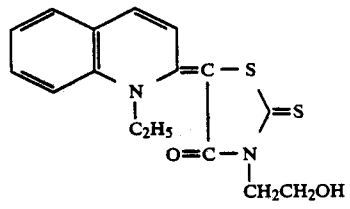

11-5

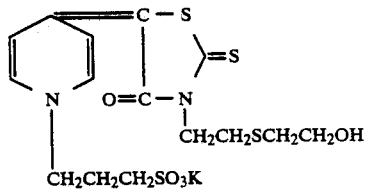

-continued
11-6
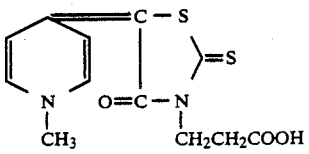
11-7
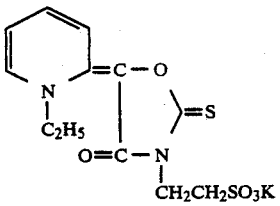
11-8
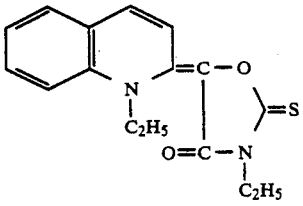
11-9
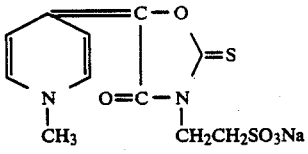
11-10
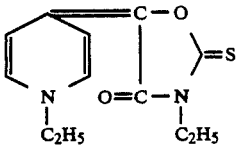
11-11
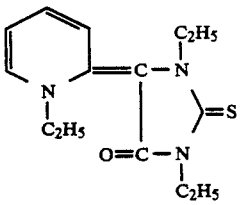
11-12
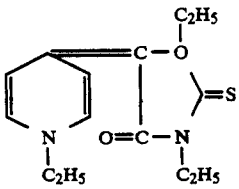
11-13
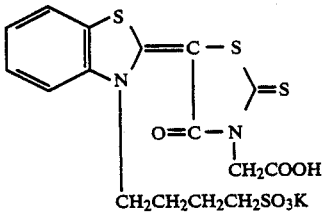
-continued
11-14
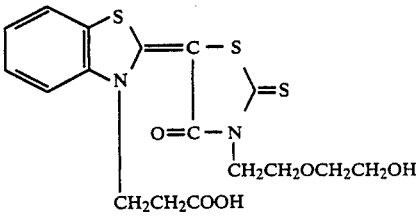
11-15
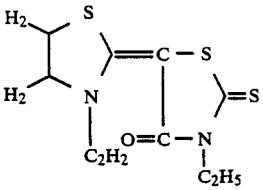
11-16
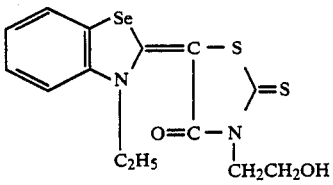
11-17
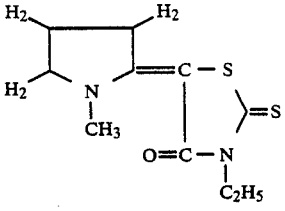
11-18
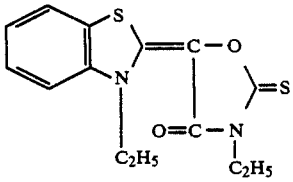
11-19
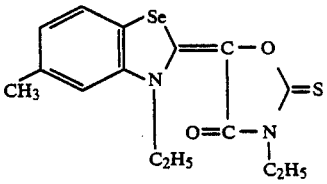
11-20
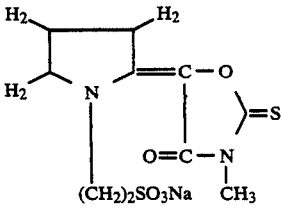
11-21
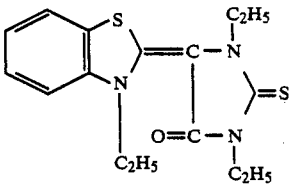

-continued 11-22

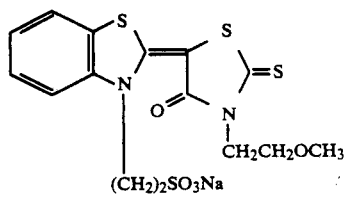

11-23

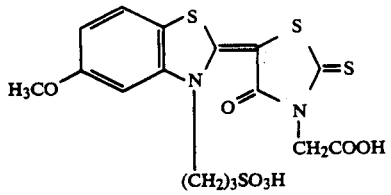

11-24

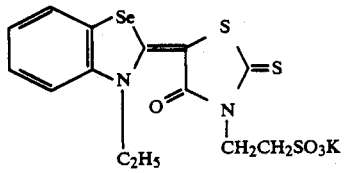

11-25

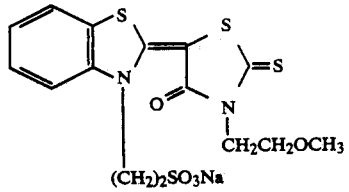

Any of these compounds having Formula 11, applicable to this invention, may be easily synthesized in accordance with those methods as described in, e.g., U.S. Pat. No. 2,161,331 and West German Patent No. 936,071.

Incorporation/dispersion of any of these sensitizing dyes of Formulas 8 through 11, applicable to this invention, into a silver halide emulsion may be carried out in accordance with various methods of the prior art, such as, for example, those methods of dispersing sensitizing dyes along with a surface active agent as described in Japanese Patent Examined Publication No. 44895/1974 and Japapnese Patent O.P.I. Publication No. 11419/1975; those methods of adding sensitizing dyes in the form of a dispersed product with a hydrophilic substrate as described in Japanese Patent O.P.I. Publication Nos. 16624/1978, 102732/1978, 102733/1978, U.S. Pat. Nos. 3,469,987 and 3,676,147; and those methods of adding sensitizing dyes in the form of a solid solution as described in East German Patent No. 143,324. Aside from the above methods, a different method may also be used which is such that a merocyanine dye is dissolved into a single or mixed water-soluble solvent such as water, ethanol, methanol, acetone, propanaol, fluorinated alcohol, pyridine, etc., and the solution is then added to an emulsion. The addition may be made at any point of time in the course of preparing an emulsion, but is preferably to be made during or after the emulsion's chemical ripening. The adding amount of these sensitizing dyes having Formulas 8, 9 and 10, usable in this invention, is an amount necessary for the spectral sensitization of a silver halide emulsion, such as, e.g., $10^{-5}$ to $2\times10^{-2}$ mole per mole of silver halide, and more preferably from $10^{-4}$ to $2\times10^{-3}$ mole.

The silver halide photographic emulsion of the light-sensitive material to be used in this invention may contain a hardening agent, examples of which include those commonly usable as hardening agents; aldehydes such as formaldehyde, glyoxal, glutaraldehyde, mucochloric acid, etc.; N-methylol compounds such as dimethylol urea, methylol-dimethylhydantoin, etc.; dioxane derivatives such as 2,3-dihydroxydioxane, etc.; active vinyl compounds such as 1,3,5-triacryloyl-hexahydro-s-triazine, bis(vinylsulfonyl)methyl ether, etc.; active halogen compounds such as 2,4-dichloro-6-hydroxy-s-triazine, etc.; and the like. These may be used alone or in combination. The emulsion may also use those commonly applicable additives such as a viscosity increasing agent, matting agent, coating aid, and the like, and further a protective colloid hydrophilic binder material as its binder.

Furthermore, the light-sensitive material of this invention may, according to purposes, contain ordinary additives such as couplers, ultraviolet absorbing agent, brightening agent, image stabilizer. oxidation inhibitor, lubricant, sequestering agent, dispersing agent, and the like.

The light-sensitive material for use in the method of this invention may have non-silver-halide-emulsion layers such as a protective layer, intermediate layers, filter layers, antihalation layer, subbing layer, auxiliary layers, antiirradiation layer, and the like. As the support for these layers, baryta paper, polyethylene-laminated paper, cellulose acetate film, cellulose nitrate film, polyethylene terephthalate film and the like may be arbitrarily selected according to the purpose for which the light-sensitive material is used.

The light-sensitive silver halide emulsion layer and other layers coated on the support may contain a homo- or copolymer latex comprised of an alkyl acrylate, alkyl methacrylate, acrylic acid, glycidyl acrylate, etc., for the purpose of improving the dimensional stability of layers' physical property of the light-sensitive material.

The light-sensitive silver halide emulsion may contain a stabilizer or antifoggant such as 4-hydroxy-6-methyl-1,3,3a,7-tetrazaindene, 1-phenyl-5-mercaptotetrazole, resolcinol-oxime, hydroiquinone-aldoxime or any of various other equivalent compounds, which may be added in an amount of from $10^{-4}$ to $10^{-1}$ mole per mole of silver halide.

EXAMPLES

The present invention will be illustrated further in detail, but the invention is not limited to and by the examples.

EXAMPLE 1

Silver iodobromide grains containing 1.5 mole % silver iodide were prepared, which were cubic grains having an average grain size of 0.30 μm. The silver halide grains were subjected to both gold sensitization and sulfur sensitization, then to this emulsion were added a sensitizing dye and a stabilizer 4-hydroxy-6-methyl-1,3,3a,7-tetrazaindene, and then the emulsion was divided into 13 parts so that each part contains mole of silver halide. To these parts of the emulsion were added 3-pyrazolidone compounds and di- or trihydroxybenzene-type compounds of the kinds and in the amounts specified in Table 4, and further were added saponin, formalin and glyoxal. And each of these emulsions was coated on a polyethylene terephthalate support so that the coating weight of the silver was 4.5 g/m², and over this emulsion layer was coated a gelatin protective layer so that the coating weight of the gelatin was 1.8 g/m², and the layers were dried, whereby light-sensitive material samples were obtained.

Each sample was cut into a small piece, and the piece was exposed for 20 seconds through a step wedge with a contact screen for negative use (100 lines per inch) attached to its one side to a tungsten light. This sample was processed for 30 seconds at 35° C. in the following developer solution and fixing solution by using KONICA Automatic Processor GR-27 (manufactured by KONICA CORPORATION).

Each of the thus processed samples was measured by means of a KONICA Digital Densitometer PDP-65, and the sensitivity of each, sample was expressed as a relative speed to the Sample No.1 s sensitivity obtained at a density point of 3.0, which was regarded as 100, and further the tangent to the line between the density points of 0.3 and 3.0 was expressed as the gamma of each sample. Also, evaluation of the halftone dot quality of each sample was made in the manner of visual observation through a 100-power magnifier and by rating the quality on the basis of 10-grade evaluation system, in which those dots with their periphery having little or no fringe and being smooth are rated Grade 10, while those dots with their periphery having much fringe and being jagged are rated Grade 1.

| Developer Solution: | |
|---|---|
| Disodium ethylenediaminetetraacetate | 1 g |
| Sodium sulfite | 60 g |
| Hydroquinone | 35 g |
| 5-Amino-pentanol | 50 g |
| Sodium bromide | 2.5 g |

-continued

| | |
|---|---|
| 5-Methyl-benzotriazole | 0.3 g |
| 1-Phenyl-3-pyrazolidone | 0.2 g |
| Water to make 1 liter. | |
| Adjust the pH to 11.5 by using sodium hydroxide. | |

| Fixer Solution: | |
|---|---|
| Composition A: | |
| Ammonium thiosulfate (aqueous 72.5% W/V sol.) | 240 ml |
| Sodium sulfite | 17 g |
| Sodium acetate, trihydrated | 6.5 g |
| Boric acid | 6 g |
| Sodium citrate, dihydrated | 2 g |
| Composition B: | |
| Pure water (ion-exchanged water) | 17 ml |
| Sulfuric acid (aqueous 50% W/V sol.) | 4.7 g |
| Aluminum sulfate (aqueous 8.1% W/V $Al_2O_3$ equivalent sol.) | 26.5 g |

Before use, dissolve Composition A and Composition B in the order given into 500 ml of water, and then add water to make one liter. Adjust the pH of this fixer solution to 6 by using acetic acid.

TABLE 4

| Sample No. | Hyddrzide cpd. No. | Hyddrzide cpd. Added amt g/mol AgX | Di(tri)hydroxy-benzene-type cpd. No. | Di(tri)hydroxy-benzene-type cpd. Added amt g/mol AgX | Relative speed | Gamma | Fog | Half-tone dot qlty. | 3-Pyrazolidone cpd. No. | 3-Pyrazolidone cpd. Added amt mg/mol AgX |
|---|---|---|---|---|---|---|---|---|---|---|
| 1 | — | — | — | — | 20 | 2.5 | 0.06 | 2 | A-2 | 200 |
| 2 | — | — | B-1 | 0.5 | 22 | 2.5 | 0.05 | 2 | A-2 | 200 |
| 3 | — | — | B-1 | 7.5 | 25 | 2.5 | 0.05 | 2 | A-2 | 200 |
| 4 | 1-10 | 0.5 | — | — | 95 | 7.6 | 0.05 | 6 | A-2 | 200 |
| 5 | 1-2 | 7.5 | — | — | 98 | 7.6 | 0.05 | 6 | A-2 | 200 |
| 6 | 1-10 | 0.5 | B-1 | 0.5 | 100 | 15.1 | 0.04 | 5 | — | — |
| 7 | 2-5 | 0.5 | B-1 | 7.5 | 122 | 15.6 | 0.04 | 5 | — | — |
| 8 | 2-7 | 0.5 | B-1 | 15.0 | 123 | 14.6 | 0.04 | 8 | A-3 | 300 |
| 9 | 2-13 | 2.5 | B-1 | 2.5 | 125 | 16.2 | 0.04 | 9 | A-1 | 200 |
| 10 | 3-26 | 7.5 | B-1 | 0.5 | 120 | 16.5 | 0.04 | 10 | A-3 | 300 |
| 11 | 3-27 | 7.5 | B-2 | 7.5 | 110 | 14.3 | 0.04 | 8 | A-2 | 200 |
| 12 | 3-30 | 7.5 | B-2 | 15.0 | 105 | 14.2 | 0.04 | 8 | A-2 | 250 |
| 13 | 3-33 | 15.0 | B-3 | 2.5 | 103 | 14.6 | 0.04 | 9 | A-2 | 330 |

As is apparent from Table 4, the use of these compounds of this invention enables the formation of high-contrast, high-quality halftone dots.

EXAMPLE 2

An emulsion containing silver chlorobromide grains comprised of 65 mole % silver chloride and 35 mole % silver bromide was prepared. This emulsion was used to prepare Samples No. 21 to No. 31 in the same manner as in Example 1 except that compounds of Formulas 4, 5 and 6 were used in combination with the hydrazide compounds of this invention.

The obtained samples were evaluated in the same manner as in Example 1. The compositions and the evaluated results of the respective samples are given in Table 5.

TABLE 5

| Sample No. | Hydrazide cpd. No. | Hydrazide cpd. added amt g/mol AgX | 3-Pyrazolidone cpd. No. | 3-Pyrazolidone cpd. added amt g/mol AgX | Di(tri)hydroxy-benzene cpd. No. | Di(tri)hydroxy-benzene cpd. added amt g/mol AgX | Compound of Formula 4 No. | Compound of Formula 4 added amt g/mol AgX |
|---|---|---|---|---|---|---|---|---|
| 21 | 3-25 | 1.3 | — | — | — | — | — | — |
| 22 | " | " | A-2 | 3 | — | — | — | — |
| 23 | " | " | A-2 | 3 | B-1 | 3 | 4-7 | 1.0 |
| 24 | " | " | A-2 | 3 | B-1 | 2 | 4-4 | 1.0 |
| 25 | " | " | A-4 | 3 | B-1 | 3 | 4-16 | 1.0 |
| 26 | " | " | A-5 | 3 | B-1 | 2 | — | — |
| 27 | 2-47 | " | A-6 | 3 | B-1 | 2 | — | — |
| 28 | " | " | A-6 | 3 | B-1 | 2 | — | — |
| 29 | " | " | A-1 | 3 | B-1 | 2 | 4-7 | 1.0 |

TABLE 5-continued

| | | | | | | | | |
|---|---|---|---|---|---|---|---|---|
| 30 | " | " | A-1 | 3 | B-1 | 2 | 4-7 | 1.0 |
| 31 | " | " | A-2 | 3 | B-1 | 2 | 4-7 | 1.0 |

| Sample No. | Compound of Formula 5 No. | Compound of Formula 5 added amt g/mol AgX | Compound of Formula 6 No. | Compound of Formula 6 added amt g/mol AgX | Relative speed | Gamma | Fog |
|---|---|---|---|---|---|---|---|
| 21 | — | — | — | — | 100 | 2.6 | 0.20 |
| 22 | — | — | — | — | 200 | 15 | 0.18 |
| 23 | — | — | — | — | 180 | 16 | 0.15 |
| 24 | — | — | — | — | 190 | 17 | 0.04 |
| 25 | — | — | — | — | 210 | 17 | 0.04 |
| 26 | 5-1 | 1.0 | — | — | 205 | 16 | 0.04 |
| 27 | 5-2 | 1.0 | — | — | 208 | 15 | 0.05 |
| 28 | 5-10 | 1.0 | — | — | 213 | 13 | 0.06 |
| 29 | 5-1 | 1.0 | 6-1 | 0.5 | 200 | 16 | 0.04 |
| 30 | 5-1 | 1.0 | 6-3 | 0.5 | 198 | 18 | 0.03 |
| 31 | 5-1 | 0.5 | 6-3 | 0.5 | 202 | 15 | 0.03 |

As is apparent from Table 5, these samples containing the hydrazide compound of this invention enable the formation of very high-contrast halftone dots with little or no fog.

What is claimed is:

1. A method for forming an image comprising the step of developing a silver halide photographic light-sensitive material having a silver halide emulsion layer with a developer, wherein said silver halide emulsion layer contains a compound selected from the consisting of 3-pyrazolidone type compounds, dihydroxybenzene type compounds and trihydroxybenzene type compounds;

said developer contains (i) a compound selected from the group consisting of dihydroxybenzene type compounds and trihydroxybenzene type compounds; (ii) a sulfite, and (iii) an amino compound; and said development is performed in the presence of a compound represented by the following Formula 1;

Formula 1

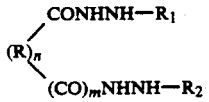

wherein $R_1$ and $R_2$ each represents an aryl group or a heterocyclic group, R is a divalent organic group, n is an integer of zero to 6 and m is an integer of zero or 1, provided that when n is 2 to 6 the Rs are the same as or different from each other.

2. The method of claim 1, wherein said compound represented by Formula 1 is contained in said silver halide photographic material.

3. The method of claim 2, wherein said compound represented by Formula 1 is contained in said photographic material in an amount of from $1\times10^{-6}$ to $1\times10^{-1}$ mole per mole of silver halide contained in said silver halide emulsion layer.

4. The method of claim 3, wherein said compound represented by Formula 1 is contained in said photographic material in an amount of from $1\times10^{-4}$ to $1\times10^{-2}$ mole per mole of silver halide contained in said silver halide emulsion layer.

5. The method of claim 1, wherein said compound represented by Formula 1 is contained in said developer.

6. The method of claim 5, wherein said compound represented by formula 1 is contained in said developer in an amount of from $1\times10^{-5}$ to $1\times10^{-2}$ mole per liter of the developer.

7. The method of claim 6, wherein said compound represented by formula 1 is contained in said developer in an amount of from $1\times10^{-3}$ to $1\times10^{-4}$ mole per liter of the developer.

8. The method of claim, 1, wherein said 3-pyrazolidones compound are represented by the following formula;

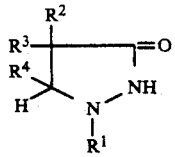

wherein $R^1$ is an unsubstituted or substituted aryl group; $R^2$, $R^3$ and $R^4$ each is an unsubstituted or substituted alkyl group.

9. The method of claim 1, wherein said dihydroxybenzene comounds and trihydroxybenzene compounds are represented by the following formula;

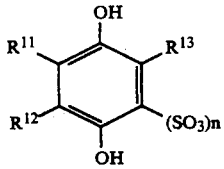

wherein $R^{11}$, $R^{12}$ and $R^{13}$ each is a hydrogen atom, a halogen atom, an alkyl group, an aryl group, a heterocyclic group, an —$OR^{14}$ group or an —$SR^{14}$ group; $R^{14}$ is a hydrogen atom, an alkyl group, an aryl group or a heterocyclic group; n is an integer of zero or 1.

10. The method of claim 1, wherein said dihydroxybenzene compound or trihydroxybenzene compound is contained in said silver halide emulsion layer in an amount of from 0.001 to 0.10 mole per mole of silver halide.

11. The method of claim 10, wherein said dihydroxybenzene compound or trihydroxybenzene compound is contained in said said silver halide emulsion layer in an amount of from 0.005 to 0.03 mole per mole of silver halide.

12. The method of claim 1, wherein said dihydroxybenzene or trihydroxybenezene compound is contained in said developer in an amount of from 0.05 to 0.5 mole per litler of the developer.

13. The method of claim 1, wherein said sulfite is sodium sulfite, potssium sulfite, lithium sulfite, ammonium sulfite, sodium bisulfite, potassium metabisulfite or an additional compound of formaldehyde with sodium bisulfite.

14. The method of claim 1, wherein said sulfite is contained in said developer in an amount of not less than 0.05 mole per liter of the developer.

15. The method of claim 14, wherein said sulfite is contained in said developer in an amount of not less than 0.15 mole per liter of the developer.

16. The method of claim 1, wherein said amine is an alkanol amine represented by the following formula;

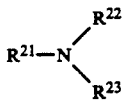

wherein $R^{21}$ is a hydroxyalkyl group having 2 to 10 carbon atoms; $R^{22}$ and $R^{23}$ each is a hydrogen atom, an alkyl group having 1 to 10 carbon atoms, a hydroxy alkyl having 2 to 10 carbon atoms; a benzyl group or a

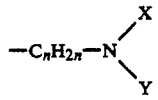

group, in which n is an integer of 1 to 10, X and Y each is a hydrogen atom, an alkyl group having 1 to 10 carbon atoms or a hydroxyalkyl group having 2 to 10 carbon atoms.

17. The method of claim 1, wherein said amine is an alkyl amine represented by the following formula;

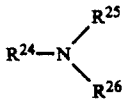

wherein $R^{24}$ is an alkyl group having 1 to 10 carbon atoms; $R^{25}$ and $R^{26}$ each is a hydrogen atom or an alkyl group.

18. The method of claim 1, wherein said amine is contained in said developer in an amount of from 0.01 to 1.0 mole per liter of the developer.

19. The method of claim 18, wherein said amine is contained in said developer in an amount of from 0.01 to 0.04 mole per liter of the developer.

20. The method of claim 1, wherein silver halde emulsion comprised of said silver halide emulsion layer has a silver bromide content of not less than 50 mole %.

21. The method of claim 20, wherein said silver halide emulsion has a silver iodide content of not more than 5 mole %.

22. The method of claim 1, wherein said silver halide photographic material coantains a compound represented by the following Formula 4;

Formula 4

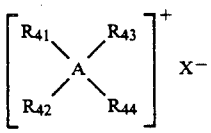

wherein A is a phosphorous atom or a nitrogen atom; $R_{41}$, $R_{42}$, $R_{43}$ and $R_{44}$ each is an alkyl group, an aryl group or an aralkyl group; and X is an acid anion.

23. The method of claim 1, wherein said silver halide photographic material coantains a compound represented by the following Formula 5;

Formula 5

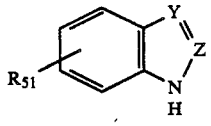

wherein Y and Z each is a nitrogen atom or a carbon atom, provided that when either one of Z and Y is a nitrogen atom, the other is a carbon atom; $R_{51}$ is a hydrogen atom, a lower alkyl group, a halogen atom or a nitro group.

24. The method of claim 1, wherein said silver halide photographic material coantains a compound represented by the following Formula 6;

Formula 6

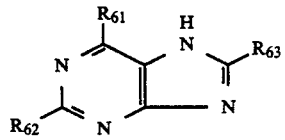

wherein $R_{61}$, $R_{62}$ and $R_{63}$ each is a hydrogen atom, a hydroxy group, an amino group, a mercapto group, an alkyl group or an aryl group.

25. The method of claim 1, wherein said silver halide photographic material contains a compound represented by the following Formula 7;

Formula 7

Formula 7

$$Y\text{-}[S\text{-}L_1\text{-}(J_1)k\text{-}(L_2)l\text{-}(Z)m\text{-}(L_3)n\text{-}(J_2L_4)p(G)q]r$$

wherein $L_1$ through $L_4$ each is a divalent hydrocarbon group, $J_1$ and $J_2$ each is an —O— atom, a —COO— group, a —$CONR_{71}$— group, an —$SO_2NR_{71}$— group, an —$NR_{71}$—CO—$NR_{72}$— group, an —$SO_2$— group, an —N=N group, an —$NR_{71}$— group or —CO— group; Y is a hydrogen atom, a divalent group or a linkage, or an amidino group; Z is a heterocyclic group; G is a sulfonic acid group, a carboxyl group or a phosphoric acid group; $R_{71}$ and $R_{72}$ each is a hydrogen atom, an alkyl group or an aryl group; k, l, m, and n each is an integer of 0 to 2; p is an integer of 0 to 4; q is an integer of 1 to 4 and r is an integer of 1 to 2; provided that when G is a carboxyl group, m is an integer of 1 to 2, and when Y is a divalent group or a linkage, r is 2.

* * * * *

UNITED STATES PATENT AND TRADEMARK OFFICE

CERTIFICATE OF CORRECTION

PATENT NO. : 4,988,603

DATED : January 29, 1991

INVENTOR(S) : Yasuhiko Takamuki et al.

It is certified that error appears in the above-identified patent and that said Letters Patent is hereby corrected as shown below:

Claim 12, column 93, line 2, change "litler" to --liter--.

Claim 13, column 93, line 2 change "potssium" to --potassium--.

Claim 20, column 93, line 59, change "halde" to --halide--

Signed and Sealed this

Eighteenth Day of March, 1997

Bruce Lehman

*Attest:*

BRUCE LEHMAN

*Attesting Officer*

*Commissioner of Patents and Trademarks*